US007852294B2

(12) United States Patent
Han

(10) Patent No.: US 7,852,294 B2
(45) Date of Patent: Dec. 14, 2010

(54) PLASMA DISPLAY APPARATUS AND DRIVING METHOD THEREOF

(75) Inventor: Jung Gwan Han, Kumi-si (KR)

(73) Assignee: LG Electronics Inc., Seoul (KR)

( * ) Notice: Subject to any disclaimer, the term of this patent is extended or adjusted under 35 U.S.C. 154(b) by 882 days.

(21) Appl. No.: 11/321,055

(22) Filed: Dec. 30, 2005

(65) Prior Publication Data

US 2006/0145958 A1 Jul. 6, 2006

(30) Foreign Application Priority Data

Dec. 31, 2004 (KR) ..... 10-2004-0118548

(51) Int. Cl.
*G09G 3/28* (2006.01)

(52) U.S. Cl. ..... 345/67

(58) Field of Classification Search ..... 345/60–72; 315/169.3–169.4; 348/739, 797, 715
See application file for complete search history.

(56) References Cited

U.S. PATENT DOCUMENTS

| | | | | |
|---|---|---|---|---|
| 6,411,268 | B1 * | 6/2002 | Nakamura et al. | 345/60 |
| 6,483,250 | B1 | 11/2002 | Hashimoto et al. | 315/169.4 |
| 6,756,950 | B1 | 6/2004 | Tsai et al. | 345/60 |
| 2001/0017605 | A1 | 8/2001 | Hashimoto et al. | 345/60 |
| 2001/0024179 | A1 * | 9/2001 | Nakamura | 345/60 |
| 2002/0018033 | A1 * | 2/2002 | Tanaka et al. | 345/60 |
| 2002/0033675 | A1 * | 3/2002 | Kang et al. | 315/169.1 |
| 2002/0057231 | A1 | 5/2002 | Huang et al. | 345/60 |
| 2002/0067136 | A1 * | 6/2002 | Okamura et al. | 315/169.3 |
| 2002/0067321 | A1 * | 6/2002 | Kanazawa et al. | 345/60 |
| 2002/0075206 | A1 * | 6/2002 | Takeda et al. | 345/60 |
| 2003/0122742 | A1 * | 7/2003 | Akiba | 345/63 |
| 2003/0189534 | A1 * | 10/2003 | Myoung et al. | 345/67 |
| 2003/0222835 | A1 * | 12/2003 | Yoon et al. | 345/60 |
| 2004/0085262 | A1 * | 5/2004 | Lee | 345/41 |
| 2005/0088375 | A1 | 4/2005 | Son | 345/60 |
| 2005/0116895 | A1 * | 6/2005 | Lee et al. | 345/60 |
| 2005/0225513 | A1 * | 10/2005 | Jung et al. | 345/63 |
| 2006/0109211 | A1 * | 5/2006 | Jung | 345/67 |
| 2006/0158387 | A1 * | 7/2006 | Kim | 345/60 |
| 2006/0262041 | A1 * | 11/2006 | An | 345/67 |

FOREIGN PATENT DOCUMENTS

| | | |
|---|---|---|
| CN | 1354451 | 6/2002 |
| EP | 0 657 861 A1 | 6/1995 |
| TW | 508552 B | 11/2002 |

OTHER PUBLICATIONS

Chinese Office Action dated Nov. 16, 2007.
European Search Report dated Jun. 6, 2006.

* cited by examiner

*Primary Examiner*—Chanh Nguyen
*Assistant Examiner*—Robert M Stone
(74) *Attorney, Agent, or Firm*—Ked & Associates LLP

(57) ABSTRACT

A plasma display apparatus and a driving method thereof are provided. The apparatus includes: an electrode pair having a first electrode and a second electrode, and a third electrode intersecting with the electrode pair; and a first electrode driver, a second electrode driver, and a third electrode driver for applying a driving signal to the respective electrodes, wherein the first electrode driver applies a waveform ramping-up up to a reset voltage during a reset period and falling down to a base voltage substantially without a ramp down.

19 Claims, 17 Drawing Sheets

PLASMA DISPLAY APPARATUS AND DRIVING METHOD THEREOF

BACKGROUND OF THE INVENTION

1. Field of the Invention

The present invention relates to a plasma display apparatus, and more particularly, to a plasma display apparatus for improving a construction of a driving signal to be adapted to a single scan method and a driving method thereof. Further, the present invention relates to a plasma display apparatus and a driving method thereof, for preventing erroneous discharge and abnormal discharge, enhancing a darkroom contrast, and securing an operation margin.

2. Description of the Background Art

Plasma display apparatus displays an image by exciting and emitting a phosphor using ultraviolet rays generated when an inert mixture gas is discharged. In the plasma display apparatus, thinning and large-sizing are not only easy but also a quality of picture is improved owing to a recent development of technology.

In order to embody the gray level of the image, the plasma display apparatus is time-division driven with one frame divided into several subfields having a different number of times of emission. Each subfield is divided into a reset period for initializing a whole screen, an address period for selecting a scan line and selecting a discharge cell at the selected scan line, and a sustain period for embodying the gray level depending on the number of times of discharge. For example, when the image is displayed at 256 gray levels, a frame period (16.67 ms) corresponding to 1/60 second is divided into eight subfields (SF1 to SF8) as in FIG. 1. Each of the eight subfields (SF1 to SF8) is divided into the reset period, the address period, and the sustain period as described above. The reset period and the address period of each subfield are the same at each subfield whereas the sustain period and the number of sustain pulses allocated to the sustain period are increased at a rate of $2^n$ (n=0, 1, 2, 3, 4, 5, 6, 7) at each subfield.

FIG. 2 schematically illustrates an electrode arrangement of a conventional three-electrode alternating current surface discharge type plasma display panel (Hereinafter, referred to as "PDP").

Referring to FIG. 2, the conventional three-electrode alternating current surface discharge type PDP includes scan electrodes (Y1 to Yn) and a sustain electrode (Z) formed at an upper substrate, and address electrodes (X1 to Xm) formed at a lower substrate to vertically intersect with the scan electrodes (Y1 to Yn) and the sustain electrode (Z).

Discharge cells 1 for displaying any one of red, green, and blue are arranged in matrix at intersections of the scan electrodes (Y1 to Yn), the sustain electrode (Z), and the address electrodes (X1 to Xm).

A dielectric layer and an MgO protective layer not shown are layered on the upper substrate where the scan electrodes (Y1 to Yn) and the sustain electrode (Z) are formed.

A barrier rib for preventing optical and electrical jamming between adjacent discharge cells 1 is formed on the lower substrate where the address electrodes (X1 to Xm) are formed.

The phosphor excited by the ultraviolet rays and emitting visible rays is formed at the lower substrate and a surface of the barrier rib.

The inert mixture gas, such as He+Xe, Ne+Xe, and He+Xe+Ne, is injected into a discharge space between the upper substrate and the lower substrate of the PDP.

FIG. 3 illustrates a driving waveform applied to the conventional PDP of FIG. 2. The driving waveform of FIG. 3 will be described with reference to distributions of wall charges of FIGS. 4A to 4E.

Referring to FIG. 3, each of the subfields (SFn−1 and SFn) includes the reset period (RP) for initializing the discharge cells 1 of the whole screen, the address period (AP) for selecting the discharge cell, the sustain period (SP) for sustaining the discharge of the selected discharge cell 1, and an erasure period (EP) for erasing wall charges within the discharge cell 1.

In the erasure period (EP) of the (n−1)th sub field (SFn−1), an erasure ramp waveform (ERR) is applied to the sustain electrode (Z). During the erasure period (EP), 0V is applied to the scan electrode (Y) and the address electrode (X). The erasure ramp waveform (ERR) is a positive ramp waveform that gradually increases from 0V to a positive sustain voltage (Vs). By the erasure ramp waveform (ERR), erasure discharge occurs between the scan electrode (Y) and the sustain electrode (Z) within on-cells where the sustain discharge occurs. By the erasure discharge, the wall charges within the on-cells are erased. As a result, each of the discharge cells 1 has the distribution of wall charges as shown in FIG. 4A soon after the erasure period (EP).

In a setup period (SU) of the reset period (RP) at which the nth subfield (SFn) initiates, a positive ramp waveform (PR) is applied to the scan electrode (Y), and 0V is applied to the sustain electrode (Z) and the address electrode (X). By the positive ramp waveform (PR) of the setup period (SU), a voltage of the scan electrode (Y) gradually increases from a positive sustain voltage (Vs) to a reset voltage (Vr) higher than the positive sustain voltage. By the positive ramp waveform (PR), a dark discharge not almost generating light is generated between the scan electrode (Y) and the address electrode (X) within the discharge cells of a whole screen, and at the same time, the dark discharge is generated even between the scan electrode (Y) and the sustain electrode (Z). As a result of the dark discharge, soon after the setup period (SU), positive wall charges remain on the address electrode (X) and the sustain electrode (Z), and negative wall charges remain on the scan electrode (Y) as shown in FIG. 4B. While the dark discharge is generated in the setup period (SU), a gap voltage (Vg) between the scan electrode (Y) and the sustain electrode (Z) and a gap voltage between the scan electrode (Y) and the address electrode (X) are initialized to a voltage close to a firing voltage (Vf) capable of generating the discharge.

Consequently to the setup period (SU), a negative ramp waveform (NR) is applied to the scan electrode (Y) in the setdown period (SD) of the reset period (RP). At the same time, the positive sustain voltage (Vs) is applied to the sustain electrode (Z), and 0V is applied to the address electrode (X). By the negative ramp waveform (NR), the voltage of the scan electrode (Y) gradually decreases from the positive sustain voltage (Vs) to a negative erasure voltage (Ve). By the negative ramp waveform (NR), the dark discharge is generated between the scan electrode (Y) and the address electrode (X) within the discharge cell of the whole screen and at the same time, the dark discharge is generated even between the scan electrode (Y) and the sustain electrode (Z). As a result of the dark discharge of the setdown period (SD), the distributions of wall charges within the respective discharge cells 1 are changed to addressable condition as shown in FIG. 4C. At this time, excessive wall charges unnecessary for an address discharge are erased from and a predetermined amount of wall charges remains on the scan electrode (Y) and the address electrode (X) within the respective discharge cells 1. While the negative wall charges are moved from the scan electrode (Y) and accumulated on the sustain electrode (Z), the wall charges on the sustain electrode (Z) are inverted from a positive polarity to a negative polarity. While the dark discharge is generated in the setdown period (SD) of the reset period (RP), a gap voltage between the scan electrode (Y) and the sustain electrode (Z) and a gap voltage between the scan electrode (Y) and the address electrode (X) gets close to the firing voltage (Vf).

In the address period (AP), a negative scan pulse (−SCNP) is sequentially applied to the scan electrode (Y) and at the same time, a positive data pulse (DP) is applied to the address electrode (X) in synchronization with the scan pulse (−SCNP). A voltage of the scan pulse (−SCNP) is a scan pulse (Vsc) decreasing from 0V or the negative scan reference voltage (Vyb) close to 0V to the negative scan voltage (−Vy). A voltage of the data pulse (DP) is the positive data voltage (Va). During the address period (AP), the positive Z bias voltage (Vzb) lower than the positive sustain voltage (Vs) is supplied to the sustain electrode (Z). Soon after the reset period (RP), in a state where the gap voltage is adjusted to be close to the firing voltage (Vf), the gap voltage between the scan electrode (Y) and the address electrode (X) exceeds the firing voltage (Vf) within the on-cells to which the scan voltage (Vsc) and the data voltage (Va) are applied while generating a primary address discharge between the electrodes (X and Y). The primary address discharge between the scan electrode (Y) and the address electrode (X) occurs near an edge distant from a gap between the scan electrode (Y) and the sustain electrode (Z). The primary address discharge generates priming charged particles within the discharge cell, and induces a second discharge between the scan electrode (Y) and the sustain electrode (Z) as shown in FIG. 4D. The distribution of wall charges within the on-cells generating the address discharge is shown as in FIG. 4E.

Meantime, distributions of wall charges within off-cells not generating the address discharge are substantially sustained to be in a state of FIG. 4C.

In the sustain period (SP), the sustain pulses (SUSP) of the positive sustain voltage (Vs) are alternately applied to the scan electrode (Y) and the sustain electrode (Z). If so, in the on-cells selected by the address discharge, the sustain discharge occurs between the scan electrode (Y) and the sustain electrode (Z) at each sustain pulse (SUSP) owing to the distribution of wall charges of FIG. 4E. On the contrary, in the off-cells, the discharge does not occur during the sustain period. This is because, since the distributions of wall charges of the off-cells are substantially sustained to be in the state of FIG. 4C, when the positive sustain voltage (Vs) is initially applied, the gap voltage between the scan electrode (Y) and the sustain electrode (Z) cannot exceed the firing voltage (Vf).

However, the conventional plasma display apparatus has a drawback in that, in a PDP where the subfields are increased in number so as to reduce a factor of deteriorating the quality of picture such as a contour noise, a high-resolution PDP accompanying increase of the number of lines, or a high Xe-content PDP having a great discharge delay, the address period is increased and accordingly, the sustain period being a display period is relatively insufficient. There has ever been proposed a double scan method where the address electrode (X) is two-divided and the divided address electrodes (X) are driven using mutually different address driving integrated circuits, not in a single scan method where all lines are sequentially scanned, in order to reduce the address period. The double scan method has a drawback in that, due to addition of the driving integrated circuit, a circuit cost increases and a noise appears on a divided line. Further, there has ever been proposed a dual scan method where the address electrode is not divided and the scan pulses are partially overlapped, thereby concurrently scanning plural lines. However, the dual scan method has a drawback of causing reduction of a resolution. In the conventional plasma display apparatus, as shown in FIG. 4D, since the address discharge includes a primary discharge between the scan electrode (Y) and the address electrode (X), and a secondary discharge between the scan electrode (Y) and the sustain electrode (Z) using the primary discharge, a time necessary for the discharge is relatively long. Therefore, in the conventional plasma display apparatus, even by a discharge mechanism of the address discharge, the address period gets long.

Further, in the conventional plasma display apparatus, there is a drawback in that, during the erasure period (EP) of the (n−1)th subfield (SFn−1) and the reset period (RP) of the nth subfield (SFn), the discharge is generated at several times to initialize the discharge cells 1 and control the wall charges, thereby reducing the darkroom contrast and reducing a contrast ratio. Table 1 below is an arrangement of a type and the number of times of discharge generated in the erasure period (EP) and the reset period (RP) of the previous subfield (SFn−1) in the conventional plasma display apparatus.

TABLE 1

| | | Operation period | | |
|---|---|---|---|---|
| | | | RP of SFn | |
| Cell state | | EP of SFn-1 | SU | SD |
| On-cell turned on in SFn-1 | Opposite discharge (Y-X) | X | ○ | ○ |
| | Surface discharge (Y-Z) | ○ | ○ | ○ |
| Off-cell turned off in SFn-1 | Opposite discharge (Y-X) | X | ○ | ○ |
| | Surface discharge (Y-Z) | X | ○ | ○ |

As appreciated from the Table 1, in the on-cells turned on in the (n−1)th subfield (SFn−1), during the erasure period (EP) and the reset period (RP), a surface discharge between the scan electrode (Y) and the sustain electrode (Z) is generated at three times, and an opposite discharge between the scan electrode and the address electrode is generated at two times. Further, in the off-cells turned off in the previous subfield (SFn), during the erasure period (EP) and the reset period (RP), the surface discharge between the scan electrode (Y) and the sustain electrode (Z) is generated at two times, and the opposite discharge between the scan electrode (Y) and the address electrode (X) is generated at two times.

The discharges generated at several times in the erasure period and the reset period increase an amount of emission in the erasure period and the reset period where the amount of emission should be minimized if at all possible in consideration of a contrast characteristic, thereby causing reduction of the darkroom contrast value. In particular, the surface discharge between the scan electrode (Y) and the sustain electrode (Z) provides a large amount of emission of light in comparison to the opposite discharge between the scan electrode (Y) and the address electrode (X) and therefore, has a greater bad influence on the darkroom contrast in comparison with the opposite discharge.

Further, in the conventional plasma display apparatus, in the erasure period (EP) of the (n−1)th subfield (SFn−1), the wall charges are not well erased and therefore, the negative wall charges are excessively accumulated on the scan electrode (Y), thereby not generating the dark discharge in the setup period (SU) of the nth subfield (SFn). If the dark discharge is not normally generated in the setup period (SU), the discharge cells are not ideally initialized. In order to stably generate the discharge in the setup period (SU) within the discharge cells where excessive negative wall charges are accumulated on the scan electrode (Y) before the dark discharge of the setup period (SU), the reset voltage (Vr) should be much more increased. Further, if the dark discharge is not generated in the setup period (SU), the discharge cell is not in the optimal address condition soon after the reset period, thereby causing an abnormal discharge or an erroneous discharge. Furthermore, in case where the positive wall charges are excessively accumulated on the scan electrode (Y) soon after the erasure period (EP) of the (n−1)th subfield (SFn−1), in the setup period (SU) of the nth subfield (SFn), when the positive sustain voltage (Vs) being an initiation voltage of the positive ramp waveform (PR) is applied to the scan electrode (Y), the discharge is strongly generated, thereby not uniformly initializing the whole cells. The above drawbacks will be described with reference to FIG. 5.

FIG. 5 illustrates the external application voltage (Vyz) between the scan electrode (Y) and the sustain electrode (Z) and the gap voltage (Vg) within the discharge cell in the setup period (SU). In FIG. 5, the external application voltage indicated by a solid line is an external voltage applied to each of the scan electrode (Y) and the sustain electrode (Z), and is substantially the same as the voltage of the positive ramp waveform (PR) since 0V is applied to the sustain electrode (Z). In FIG. 5, dotted lines ①, ②, and ③ denote the gap voltages (Vg) provided for a discharge gas by the wall charges within the discharge cell. The gap voltage (Vg) is varied as in the dotted lines ①, ②, and ③ since the wall charges within the discharge cell are varied in amount depending on whether or not the discharge is generated in the previous subfield. A relation of the external application voltage (Vyz) between the scan electrode (Y) and the sustain electrode (Z) and the gap voltage (Vg) provided for the discharge gas within the discharge cell is expressed in Equation 1 below.

$$Vyz=Vg+Vw \quad \text{[Equation 1]}$$

In FIG. 5, at the gap voltage (Vg) of the dotted line ①, the wall charges are sufficiently erased within the discharge cell, thereby sufficiently reducing the wall charges, and when the gap voltage (Vg) increases in proportional to the external application voltage (Vyz) and reaches the discharge firing voltage (Vf), the dark discharge is generated. By this dark discharge, the gap voltage within the discharge cells is initialized to the discharge firing voltage (Vf).

In FIG. 5, at the gap voltage (Vg) of the dotted line ②, a strong discharge is generated during the erasure period of the (n−1)th subfield (SFn−1), thereby inverting polarities of the wall charges in the wall charge distribution within the discharge cells. At this time, soon after the erasure period (EP), the polarities of the wall charges accumulated on the scan electrode (Y) are inverted into the positive polarities due to the strong discharge. This case is frequently caused by low uniformities of the discharge cells or variation of a slope of the erasure ramp waveform (ERR) depending on temperature variation. In this case, the initial gap voltage (Vg) relatively increases as in the dotted line ② of FIG. 5 and therefore, in the setup period (SU), the positive sustain voltage (Vs) is applied to the scan electrode (Y) and at the same time, the gap voltage (Vg) exceeds the discharge firing voltage (Vf), thereby generating the strong discharge. By this strong discharge, in the setup period (SU) and the setdown period (SD), the discharge cells are not initialized to be in the wall charge distribution of the optimal address condition, that is, in the wall charge distribution of FIG. 4C. Therefore, in the off-cells that should be turned off, the address discharge can be generated. In other words, when the erasure discharge is strongly generated in the erasure period prior to the reset period, the erroneous discharge can be caused.

In FIG. 5, at the gap voltage (Vg) of the dotted line ③, during the erasure period (EP) of the (n−1)th subfield (SFn−1), the erasure discharge is not generated or is very weakly generated, thereby maintaining the wall charge distribution within the discharge cells, as it is, formed as a result of the sustain discharge generated just before the erasure discharge. In a detailed description, as in FIG. 3, the last sustain discharge is generated when the sustain pulse (SUSP) is applied to the scan electrode (Y). As a result of the last sustain discharge, the negative wall charges remain on the scan electrode (Y), and the positive wall charges remain on the sustain electrode (Z). However, such wall charges should be erased through the erasure discharge in order to perform a normal initialization in a next subfield. But, when the erasure discharge is not generated or is very weakly generated after the last sustain discharge, the polarity is kept as it is. A reason why the erasure discharge is not generated or is very weakly generated is that in the PDP, the discharge cells are low in uniformity or the erasure ramp waveform (ERR) is varied in slope depending on the temperature variation. In this case, the initial gap voltage (Vg) is much low to have the negative polarity as in the dotted line ③ of FIG. 5 and therefore, even though the positive ramp waveform (PR) increases up to the reset voltage (Vr) in the setup period, the gap voltage (Vg) within the discharge cells does not reach the discharge firing voltage (Vf). Therefore, the dark discharge is not generated in the setup period (SU) and the setdown period (SD). As a result, in case where the erasure discharge is not generated or is very weakly generated in the erasure period prior to the reset period, the initialization is not normally performed, thereby causing the erroneous discharge or the abnormal discharge.

In the dotted line ② of FIG. 5, the relation of the gap voltage (Vg) and the discharge firing voltage (Vf) is expressed as in Equation 2, and in the dotted line ③ of FIG. 5, the relation of the gap voltage (Vg) and the discharge firing voltage (Vf) is expressed as in Equation 3:

$$Vg_{ini}+Vs>Vf \quad \text{[Equation 2]}$$

$$Vg_{ini}+Vr<Vf \quad \text{[Equation 3]}$$

where, $Vg_{ini}$: initial gap voltage just before the setup period (SU) is initiated as appreciated from FIG. 5.

A gap voltage condition (or wall charge condition) for performing the normal initialization in the erasure period (EP) and the reset period (RP) considering the above drawbacks is expressed in the following Equation 4 satisfying all of the Equations 2 and 3:

$$Vf-Vr<Vg_{ini}<Vf-Vs \quad \text{[Equation 4]}$$

Resultantly, if the initial gap voltage ($Vg_{ini}$) does not satisfy the condition of the Equation 4 before the setup period (SU), the conventional plasma display apparatus can cause the erroneous discharge, the misdischarge, or the abnormal discharge, and decreases the operation margin. In other words, in the conventional plasma display apparatus, in order to secure the operation reliability and the operation margin, an erasure operation in the erasure period (EP) should be normally performed but, as aforementioned, can be abnormally performed depending on the uniformity of the discharge cell or the use temperature of the PDP.

Further, in the conventional plasma display apparatus, the wall charges accumulated on the scan electrode (Y) and the sustain electrode (Z) before the reset period are not sufficient and therefore, the setup discharge occurs near the reset voltage (Vr) higher (100 V or more) than the sustain voltage (Vs). Due to this, the conventional plasma display apparatus has a drawback in that an external applied voltage is increased for the setup discharge and as a result, high voltage devices should be included in a voltage source generating a high voltage and a scan drive circuit, thereby increasing a cost of the scan drive circuit.

SUMMARY OF THE INVENTION

Accordingly, an object of the present invention is to solve at least the problems and disadvantages of the background art.

An object of the present invention is to provide a plasma display apparatus for preventing erroneous discharge, and reducing a length of a subfield to be adapted to a single scan method.

To achieve these and other advantages and in accordance with the purpose of the present invention, as embodied and broadly described, there is provided a plasma display apparatus including: an electrode pair having a first electrode and a second electrode, and a third electrode intersecting with the electrode pair; and a first electrode driver, a second electrode driver, and a third electrode driver for applying a driving signal to the respective electrodes, wherein the first electrode driver applies a waveform ramping-up up to a reset voltage during a reset period and falling down to a base voltage substantially without a ramp down.

The base voltage is a ground voltage or a predetermined voltage of less than the ground voltage.

The ramp-up waveform applied during the reset period is a waveform rising with a two-step slope.

The waveform ramping-up and falling down to the base voltage falls down to a sustain voltage and, falls down to the base voltage after the sustain voltage is sustained for a predetermined time.

In another aspect of the present invention, there is provided a plasma display apparatus including: a plurality of first electrodes; and a first electrode driver for applying a driving signal to the first electrode, wherein the first electrode driver applies a waveform ramping-up up to a reset voltage during a reset period and falling down to a base voltage substantially without a ramp down, and when applying a scan pulse during an address period, applies a first scan pulse in 3 μs to 10 μs after a time point of termination of the ramp-up waveform.

In a further another aspect of the present invention, there is provided a driving method of a plasma display apparatus having a surface discharge electrode pair having a first electrode and a second electrode, a third electrode intersecting with the electrode pair, and a plurality of discharge cells arranged at an intersection of the electrodes, the method including: a first step of, during a pre reset period, applying a negative voltage to the first electrode and applying a positive voltage to the second electrode; and a second step of, during a reset period following the pre reset period, applying a waveform ramping-up from a ground voltage to a reset voltage and falling down directly to a base voltage without a ramp down.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Preferred embodiments of the present invention will be described in a more detailed manner with reference to the drawings.

A plasma display apparatus according to the first embodiment of the present invention includes an electrode pair including a first electrode and a second electrode, a third electrode intersecting with the electrode pair, and a first electrode driver, a second electrode driver, and a third electrode driver for applying a driving signal to the respective electrodes. The first electrode driver applies a waveform that ramps-up to a reset voltage during a reset period and falls down to a base voltage substantially without ramp down.

The first electrode is a scan electrode, the second electrode is a sustain electrode, and the third electrode is an address electrode.

Figure 6:
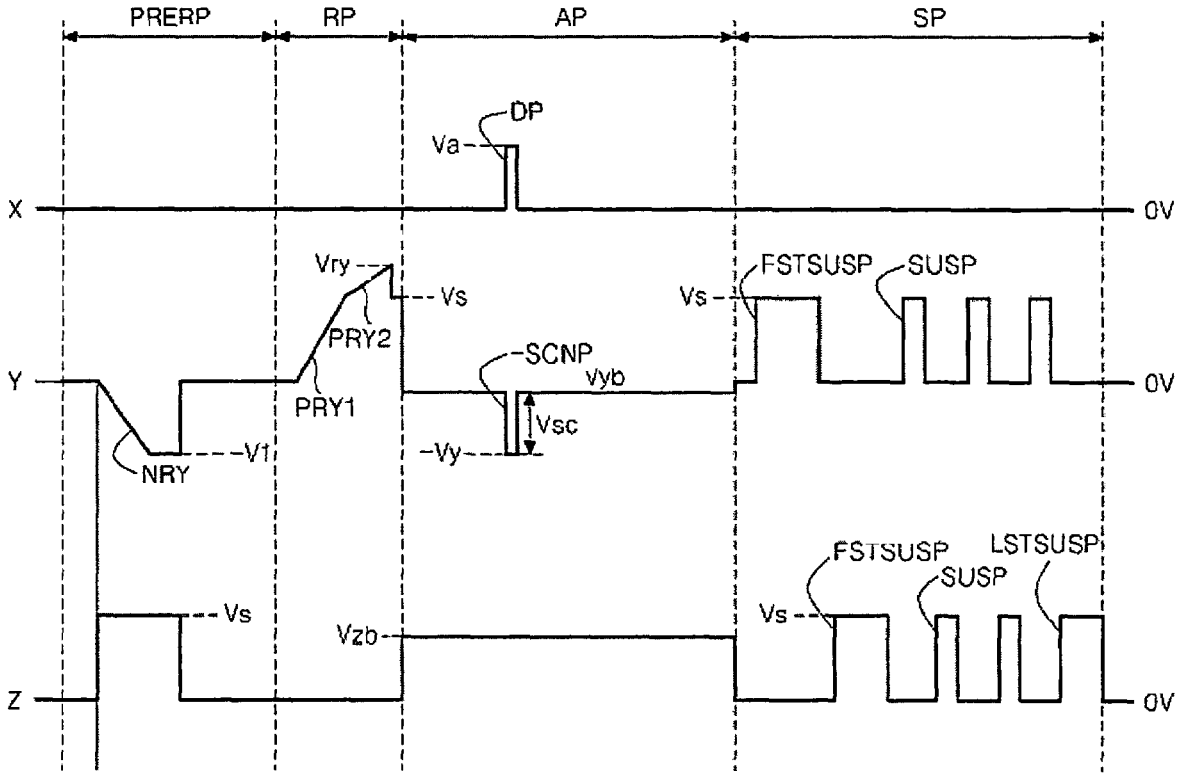
FIG. 6 illustrates a driving waveform of a plasma display apparatus according to the present invention.

FIG. 6 illustrates a driving waveform applied to each electrode during one subfield period in a plasma display apparatus according to the first embodiment of the present invention. The driving waveform of FIG. 6 will be described with reference to distributions of wall charges of FIGS. 8A to 8D.

Referring to FIG. 6, in the inventive plasma display apparatus, one subfield includes a pre reset period (PRERP) for forming positive wall charges on the scan electrode (Y) and forming negative wall charges on the sustain electrode (Z); a reset period (RP) for initializing discharge cells of a whole screen by generating only write discharge using the distribution of wall charges formed in the pre reset period (PRERP); an address period (AP) for selecting the discharge cell; and a sustain period (SP) for sustaining discharge of the selected discharge cells.

In the pre reset period (PRERP), the second electrode driver applies a positive sustain voltage (Vs) to the sustain electrode (Z) and at the same time, applies a negative ramp waveform (NRY1) reducing from a ground voltage (GND) to a negative voltage (V1) to the scan electrode (Y).

During the pre reset period (PRERP), the third electrode driver applies the ground voltage (0V) to the address electrode (X). The sustain voltage (Vs) supplied to the sustain electrode (Z) and a negative ramp waveform (NRY) supplied to the scan electrode (Y) generate a dark discharge between the scan electrode (Y) and the sustain electrode (Z) and between the sustain electrode (Z) and the address electrode (X) within all discharge cells. As a result of the discharge, soon after the pre reset period (PRERP), as in FIG. 8A, within all discharge cells, positive wall charges are accumulated on the scan electrode (Y), and negative wall charges are accumulated in a great amount on the sustain electrode (Z). Further, the positive wall charges are accumulated on the address electrode (X). By the distribution of wall charges of FIG. 8A, an enough large positive gap voltage is formed between the scan electrode (Y) and the sustain electrode (Z) in internal discharge gas spaces of the whole discharge cells, and an electric field directing from the scan electrode (Y) to the sustain electrode (Z) is formed within the discharge cell.

Figure 8A:
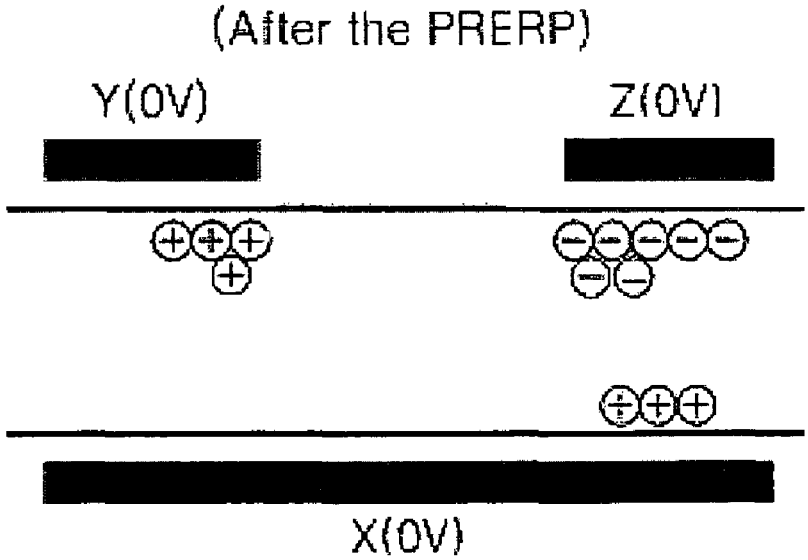
FIGS. 8A to 8D illustrate a distribution of wall charges within a discharge cell by the driving waveform of FIG. 6.

In the reset period (RP), a first positive ramp waveform (PRY1) and a second positive ramp waveform (PRY2) are consecutively applied to the scan electrode (Y), and the ground voltage (0V) is applied to the sustain electrode (Z) and the address electrode (X). The first ramp waveform (PRY1) rises from 0V to the positive sustain voltage (Vs), and the second ramp waveform (PRY2) rises from the positive sustain voltage (Vs) to a higher positive reset voltage (Vry) than the positive sustain voltage (Vs). The second positive ramp waveform (PRY2) has a more gentle slope than the first positive ramp waveform (PRY1). The first and second positive ramp waveforms (PRY1 and PRY2) and the distribution of wall charges of FIG. 8A are added while the dark discharge is generated between the scan electrode (Y) and the sustain electrode (Z) and between the scan electrode (Y) and the address electrode (X) within all discharge cells. As a result of the dark discharge, soon after the setup period (SU), as in FIG. 8B, within all discharge cells, the negative wall charges are accumulated on the scan electrode (Y) while being inverted from a positive polarity to a negative polarity, and the positive wall charges are more accumulated on the address electrode (X). As the accumulated negative wall charges are moved from the sustain electrode (Z) to the scan electrode (Y), they are partially reduced in amount but are sustained in the negative polarity.

In the inventive plasma display apparatus, after the wall charges are formed through the discharge using the positive ramp waveforms (PRY1 and PRY2) without the setdown period in the reset period (RP), the formed wall charges fall down to the base voltage (Vyb) substantially without the ramp down and then, at once, the address period (AP) follows.

The base voltage (Vyb) can be set to the ground voltage or a predetermined voltage lower than the ground voltage.

Further, the base voltage (Vyb) becomes a scan reference voltage in the address period (AP).

When the wall charges fall down to the base voltage (Vyb), they primarily fall down to the sustain voltage (Vs) and then, fall down to the base voltage after the sustain voltage (Vs) is sustained for a predetermined short time. As above, the voltage is reduced sequentially, not abruptly, thereby preventing unnecessary erroneous discharge.

Figure 1:
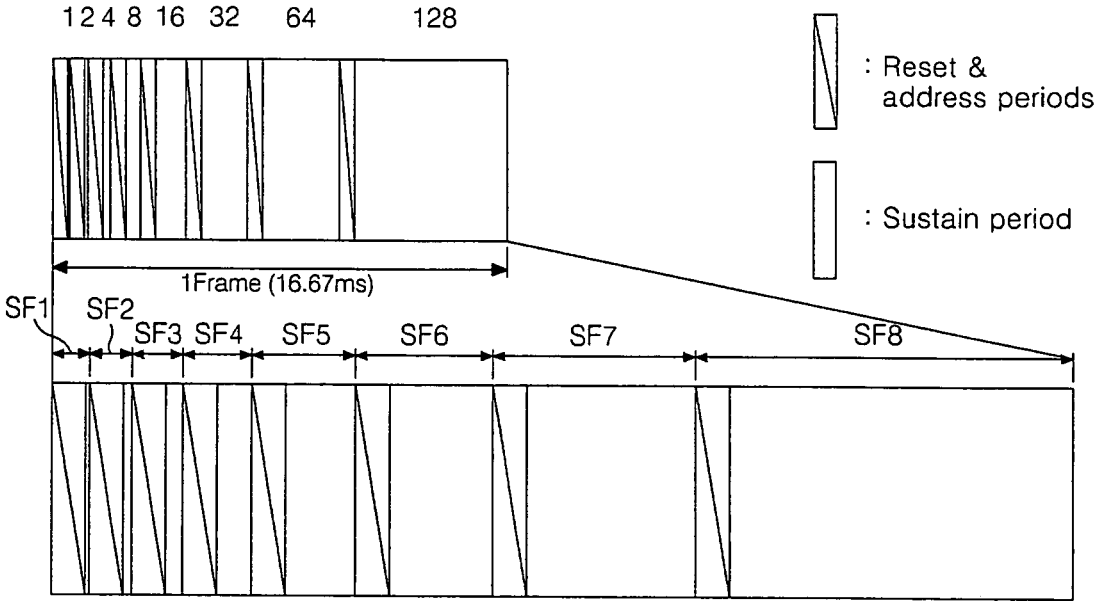
FIG. 1 (Prior Art)
FIG. 1 illustrates a conventional method for expressing a gray level in a plasma display apparatus.
Figure 2:
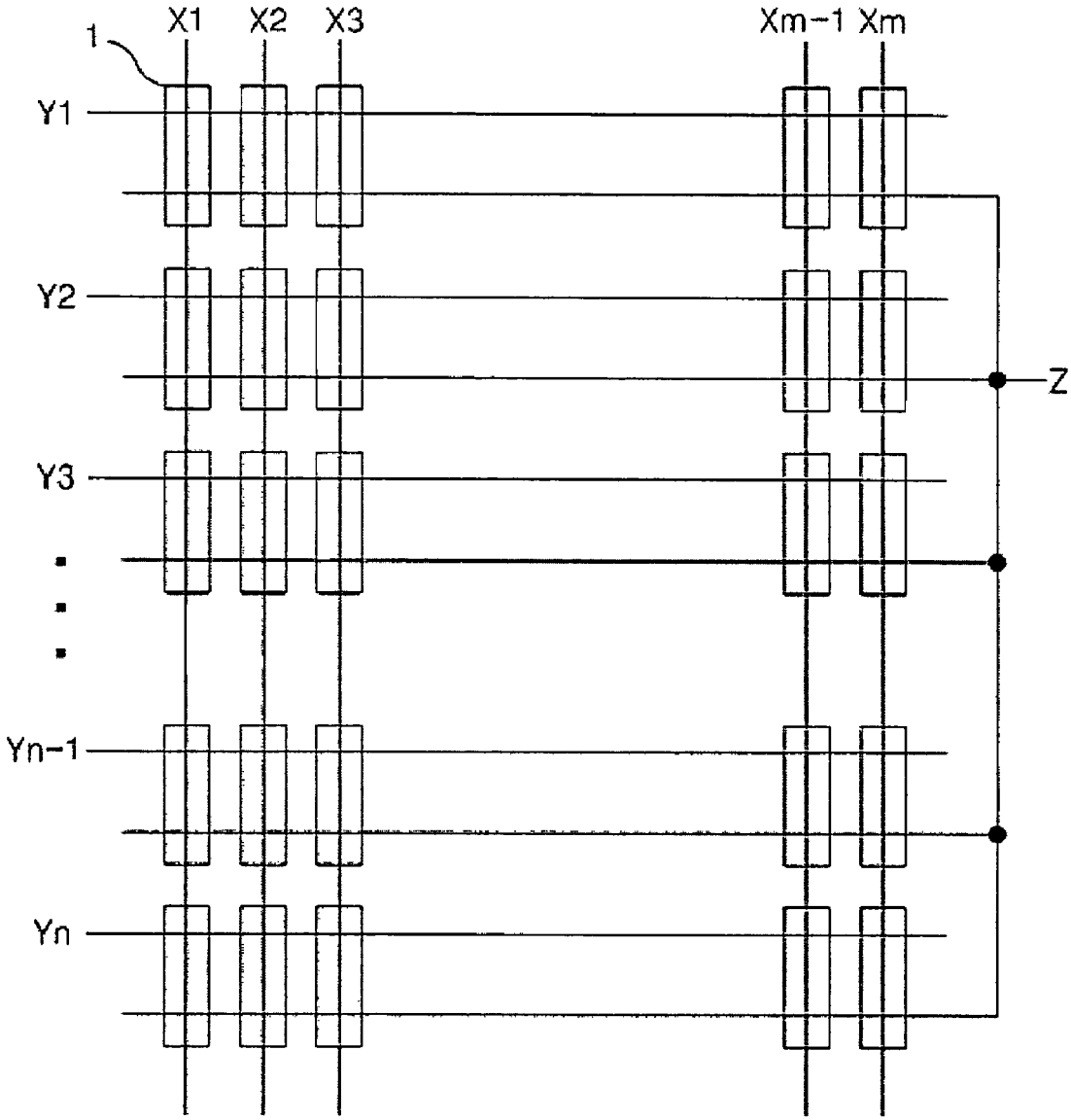
FIG. 2 (Prior Art)
FIG. 2 illustrates an electrode arrangement of a conventional plasma display apparatus.
Figure 3:
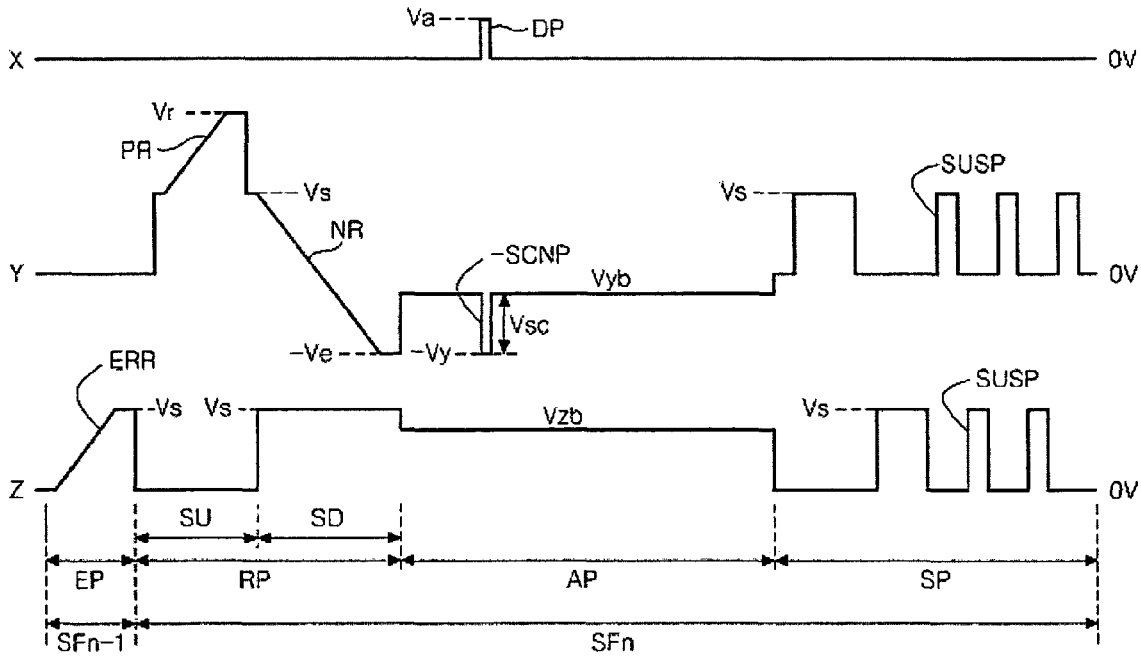
FIG. 3 (Prior Art)
FIG. 3 illustrates a driving waveform of a conventional plasma display apparatus.

Meantime, by the distribution of wall charges soon after the pre reset period (PRERP), before the dark discharge is generated in the setup period (SU), within the discharge cells, the positive gap voltage is sufficiently great and therefore, the reset voltage (Vr) applied to the scan electrode (Y) can be lower than a conventional reset voltage (Vr) shown in FIG. 3. As a result of an experiment where the distributions of wall charges of the discharge cells are initialized just before the setup discharge as shown in FIG. 8A, it was conformed that the setup discharge occurs as a weak discharge in the discharge cells at a voltage of the sustain voltage (Vs) or less, that is, at a duration of the first positive ramp waveform (PRY1). Due to this, in the driving waveform of FIG. 6, the second positive ramp waveform (PRY2) can be unnecessary and, even though the voltage applied to the scan electrode (Y) in the setup period (SU) rises only up to the sustain voltage (Vs) by the first positive ramp waveform (PRY1), the discharge can be stably generated.

While the pre reset period (PRERP) and the setup period (SU) lapse, the positive wall charges are sufficiently accumulated on the address electrode (X) and therefore, an absolute value of an external applied voltage, that is, a data voltage and a scan voltage needing in an address discharge can be reduced.

In the address period (AP), a negative scan pulse (−SCNP) is sequentially applied to the scan electrode (Y) and at the same time, a positive data pulse (DP) is synchronized to the scan pulse (−SCNP) and is applied to the address electrode (X). A voltage of the scan pulse (−SCNP) is a scan voltage (Vsc) that decreases from 0V or a negative scan reference voltage (Vyb) close to 0V, to the negative scan voltage (−Vy). A voltage of the data pulse (DP) is a positive data voltage (Va).

Figure 7A:
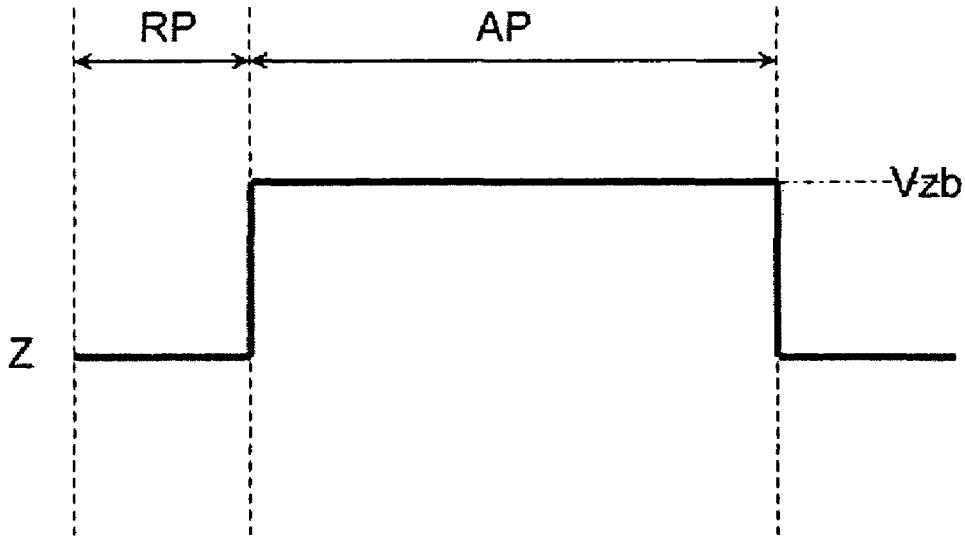
FIGS. 7A to 7C illustrate a driving waveform of a sustain electrode during an address period according to the present invention.
Figure 7B:
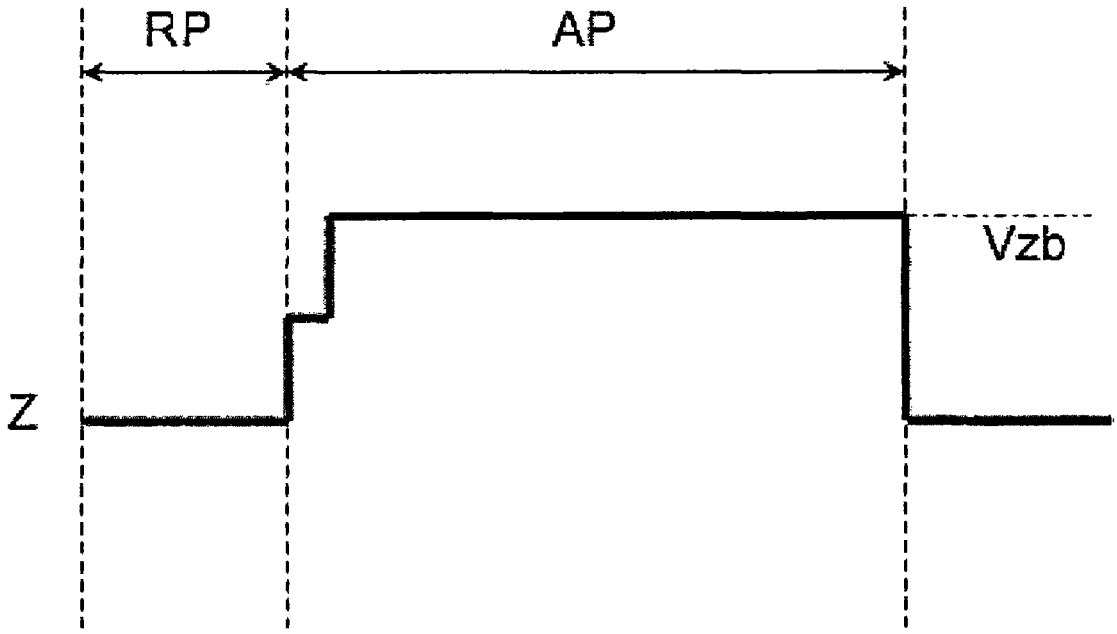
Figure 7C:
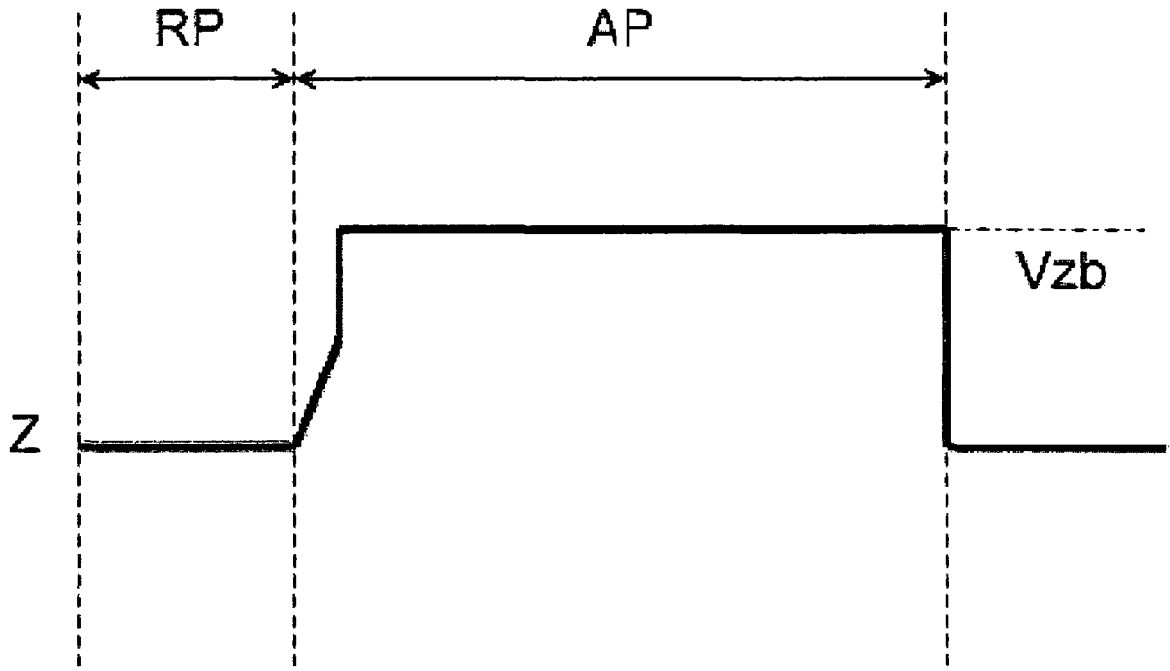

During the address period (AP), a positive Z bias voltage (Vzb) lower than the positive sustain voltage (Vs) is supplied to the sustain electrode (Z) as shown in FIG. 7A. The bias voltage can have a waveform two-stepping up from the ground voltage to the bias voltage as shown in FIG. 7B or a waveform ramping-up up to a predetermined time point and then, vertically increasing up to the bias voltage. By such the waveform, unnecessary erroneous discharge caused by a sudden voltage difference generated at an initial application time of the bias voltage can be prevented.

Figure 8B:
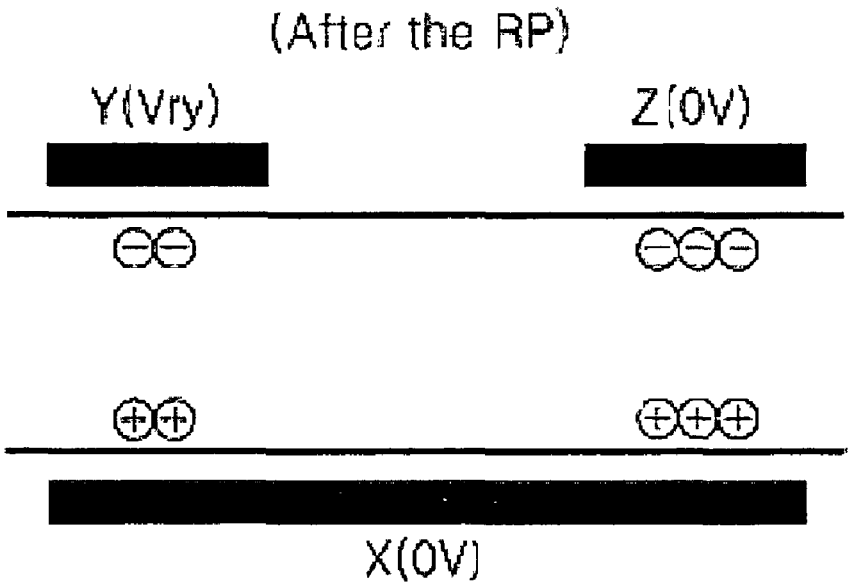
Figure 8C:
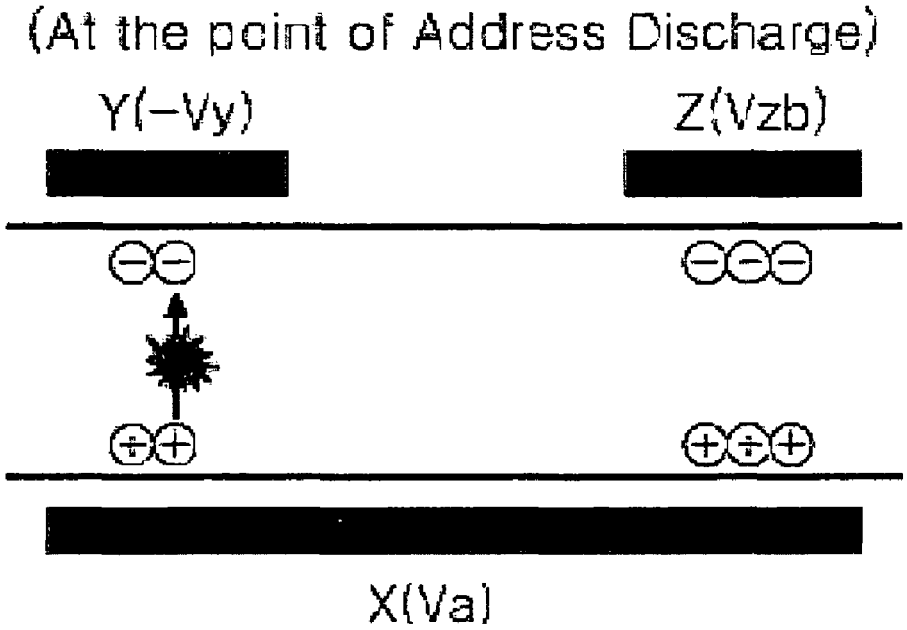
Figure 8D:
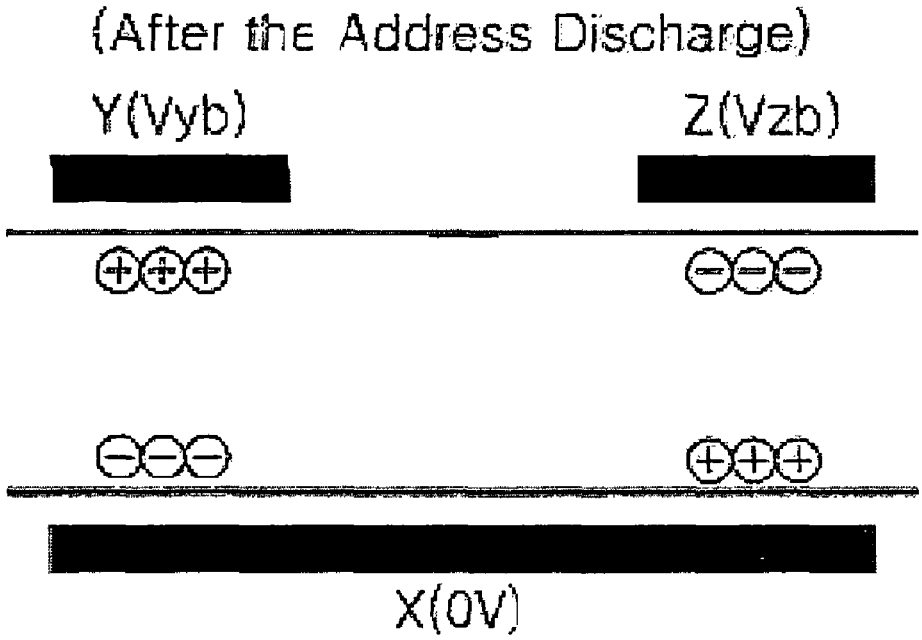

The gap voltage between the scan electrode (Y) and the address electrode (X) exceeds the discharge firing voltage (Vf), thereby generating the address discharge only between the electrodes (X, Y) within the on-cells where the scan voltage (Vsc) and the data voltage (Va) are applied. In other words, in the address discharge, the discharge occurs only between the scan electrode (Y) and the address electrode (X) within the on-cells as shown in FIG. 8C. Soon after the address discharge is generated, the wall charge distribution within the on-cells is changed as shown in FIG. 8D while the positive wall charges are accumulated on the scan electrode (Y) and the negative wall charges are accumulated on the address electrode (X) by the address discharge.

In off-cells where 0V or the base voltage is applied to the address electrode (X) or 0V or a scan reference voltage (Vyb) is applied to the scan electrode (Y), the gap voltage is less than the discharge firing voltage. Accordingly, in the off-cells where the address discharge is not generated, the wall discharge distribution is substantially sustained to be in a state of FIG. 8B.

As shown in FIG. 8C, the address discharge occurs only between the scan electrode (Y) and the address electrode (X) and therefore, a time necessary for the address discharge is greatly reduced. In the plasma display apparatus, there is not the negative ramp waveform applied in the setdown period for generating the erasure discharge and therefore, the address period is greatly reduced. In the related art, a time taken from initiation of the setdown period to just before applying of the scan pulse is 150 μs to 200 μs as shown in FIG. 10 but, in the present invention, due to absence of the setdown period, the reset period (RP) is shortened to a degree of 3 μs to 10 μs as shown in FIG. 9.

Figure 9:
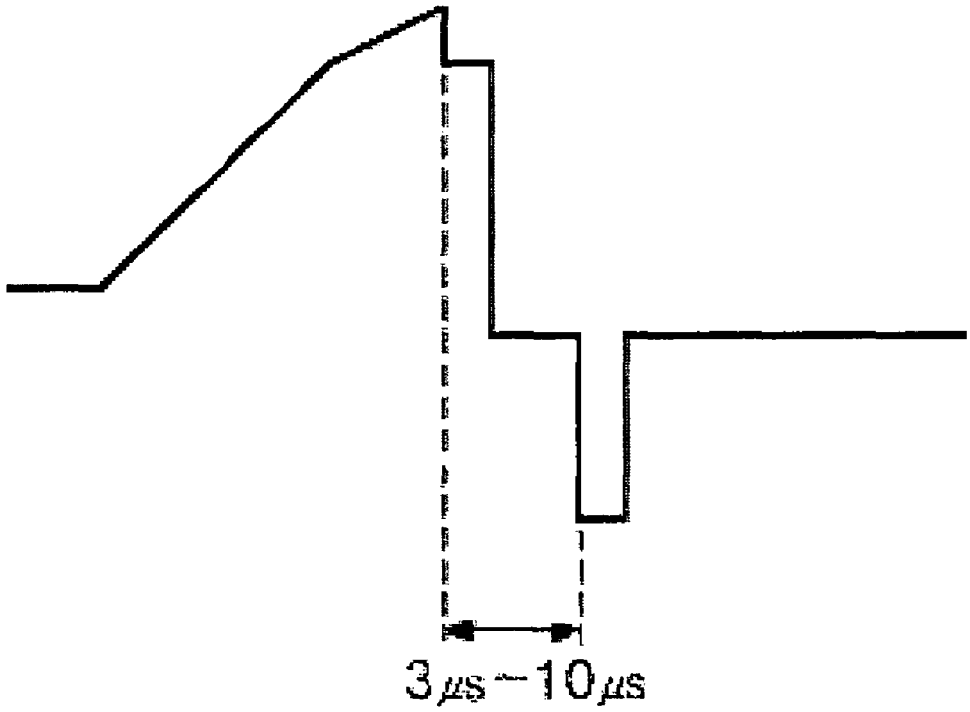
FIG. 9 illustrates a transition period between a reset period and an address period in a plasma display apparatus according to the present invention.
Figure 10:
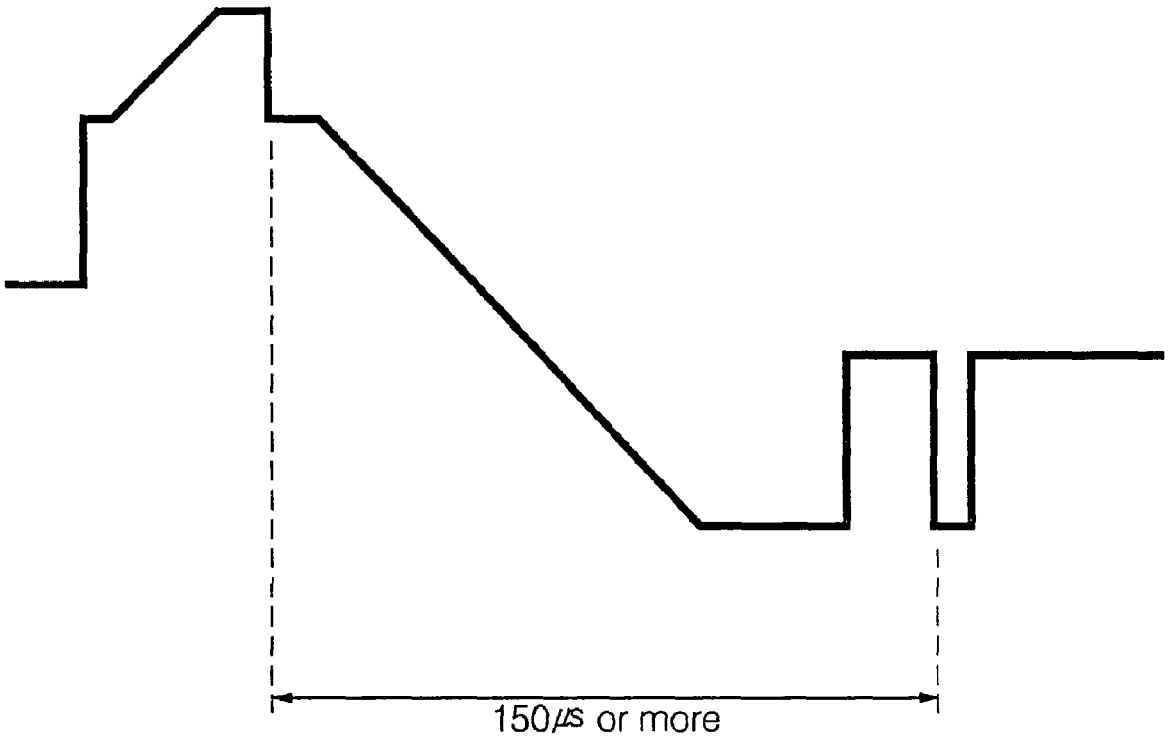
FIG. 10 illustrates a transition period between a reset period and an address period in a conventional plasma display apparatus.

For example, in the inventive plasma display apparatus, as shown in FIG. 9, a period from a time point of termination of the second positive ramp waveform (PRY2) to a time point of start of the first scan pulse is merely a period of about 3 μs to 10 μs, for example, a period of about 5 μs but, in a conventional driving method, in FIG. 10, a period from a time point of termination of a positive ramp waveform (PR) to a time point of start of A first scan pulse is 150 μs very long as shown.

In a conventional single scan driving method, as a resolution of the panel is higher, the address period is longer, and if the address period is long, the sustain period should be relatively reduced due to a fixed length of one subfield. However, there is a drawback in that, when the sustain period is shortened, the sustain pulse for expressing a constant gray level is not sufficiently applied.

However, as in the present invention, the single scan driving method provides a longer address period than a dual scan method and therefore, much as a time shortened in the reset period can be allocated to the address period or the sustain period.

In the sustain period (SP), sustain pulses (FIRSTSUSP, SUSP, and LSTSUSP) of the positive sustain voltage (Vs) are alternately applied to the scan electrode (Y) and the sustain electrode (Z). During the sustain period (SP), 0V or the base voltage is supplied to the address electrode (X). The sustain pulse (FSTSUSP) first applied to each of the scan electrode (Y) and the sustain electrode (Z) is set to have a greater pulse width than the normal sustain pulse (SUSP) so that initiation of the sustain discharge is stabilized. The last sustain pulse (LSTSUSP) is applied to the sustain electrode (Z), and is set to have a greater pulse width than the normal sustain pulse (SUSP) in an initial state of the setup period (SU) in order to sufficiently accumulate the negative wall charges on the sustain electrode (Z). The on-cells selected by the address discharge during the sustain period (SP) generate the sustain discharges between the scan electrode (Y) and the sustain electrode (Z) at each sustain pulse (SUSP) owing to the wall charge distribution of FIG. 8D. On the contrary, the off-cells have an initial wall charge distribution of the sustain period (SP) as shown in FIG. 8B and accordingly, even though the sustain pulses (FIRSTSUSP, SUSP, LSTSUSP) are applied, the gap voltage is lowly sustained to be less than the discharge firing voltage (Vf), thereby not generating the discharge.

The driving waveform of FIG. 6 is not limited only to a first subfield, and is applicable to several initial subfields including the first subfield and also to all subfields included in one frame period.

Meantime, in the inventive plasma display apparatus, a setup period of a next subfield directly follows a last sustain discharge of a previous subfield, without the erasure period for erasing the wall charges between the sustain period of the (n−1)th subfield and the reset period of the next nth subfield. The sustain discharge is a strong glow discharge and therefore, can sufficiently much accumulate the wall charges on the scan electrode (Y) and the sustain electrode (Z) and stably sustain each of polarities of the positive wall charges on the scan electrode and the negative wall charges on the sustain electrode (Z).

Figure 11:
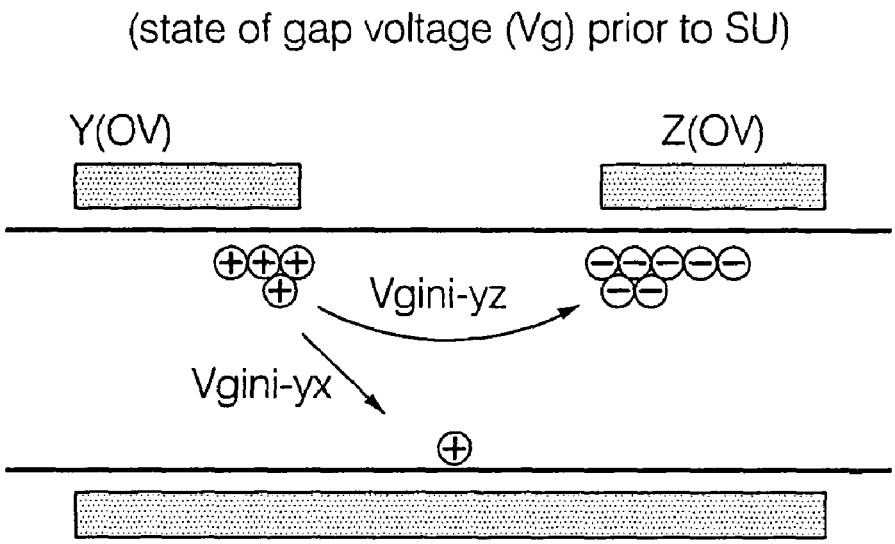
FIG. 11 illustrates a distribution of wall charges and a gap voltage within a discharge cell formed prior to a setup period by the driving waveform of FIG. 6.

FIG. 11 illustrates a gap voltage state of the discharge cell formed by the last sustain discharge following the (n−1)th subfield or the discharge of the pre reset period (PRERP).

Referring to FIG. 11, due to the last sustain pulse (LSTSUSP) or driving signals (NRY, and Vs) of the pre reset period (PRERP), the discharge is generated between the scan electrode (Y) and the sustain electrode (Z), thereby forming an inter-Y-Z initial gap voltage ($Vg_{ini}$−yz) by the electric field directing from the scan electrode (Y) to the sustain electrode (Z) directly before the setup period (SU), and forming an inter-Y-X initial gap voltage ($Vg_{ini}$−yx) by an electric field directing from the scan electrode (Y) to the address electrode (X) within the cell.

As shown in FIG. 11, in the discharge cells, the inter-Y-Z initial gap voltage ($Vg_{ini}$−yz) is already formed before the setup period (SU) and therefore, when an external voltage is applied as much as a difference between the discharge firing voltage (Vf) and the inter-Y-Z initial gap voltage ($Vg_{ini}$−yz), the dark discharge is generated within the discharge cell during the setup period (SU). This is expressed in Equation 5 below.

$$Vyz \geqq Vf-(Vg_{ini-yz}) \quad \text{[Equation 5]}$$

Here, "Vyz" is an external voltage (Hereinafter, referred to as "inter-Y-Z external voltage") applied to the scan electrode (Y) and the sustain electrode (Z) during the setup period (SU), and is voltages of the positive ramp waveforms (PRY1 and PRY2) applied to the scan electrode (Y) and 0V applied to the sustain electrode (Z) in the embodiments of FIG. 6.

Figure 12:
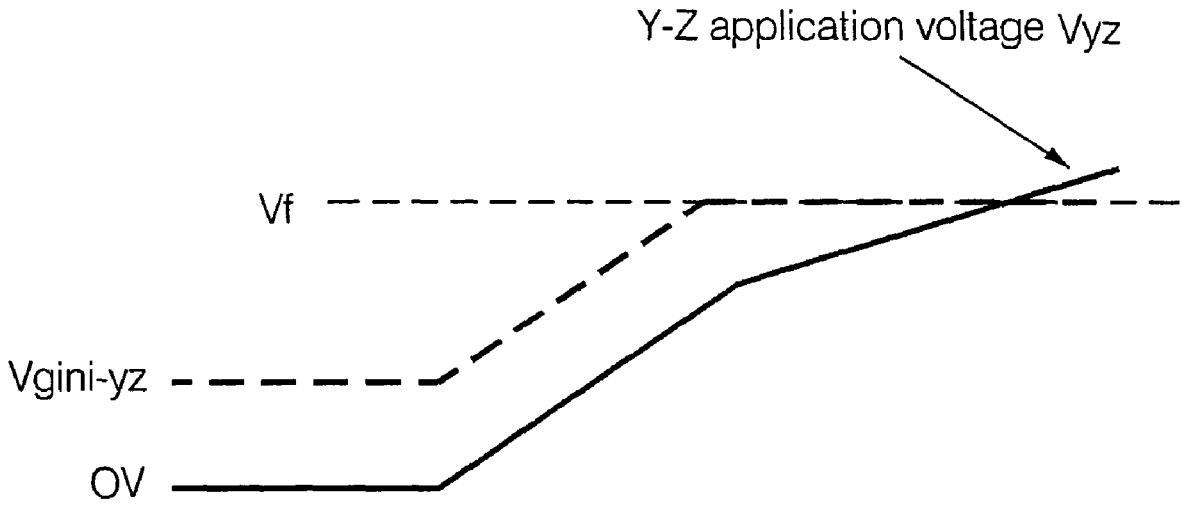
FIG. 12 illustrates a variation of a gap voltage within a discharge cell in a plasma display apparatus according to the present invention.

As appreciated from Equation 5 and FIG. 12, when the inter-Y-Z external voltage (Vyz) sufficiently increases to be more than a difference between the discharge firing voltage (Vf) and the inter-Y-Z initial gap voltage ($Vg_{ini}$−yz) during the setup period (SU), the dark discharge can be stably generated within the surface discharge cells due to a great driving margin.

In the plasma display apparatus according to the embodiment of the present invention, an amount of emission generated in the reset period at each subfield is greatly less than in a related art. This is because the number of times of emission generated within the discharge cell during the reset period of each subfield is less than that of the related art and specifically, the number of times of surface discharge is less and there is not the erasure discharge caused by the negative ramp waveform.

Figure 4A:
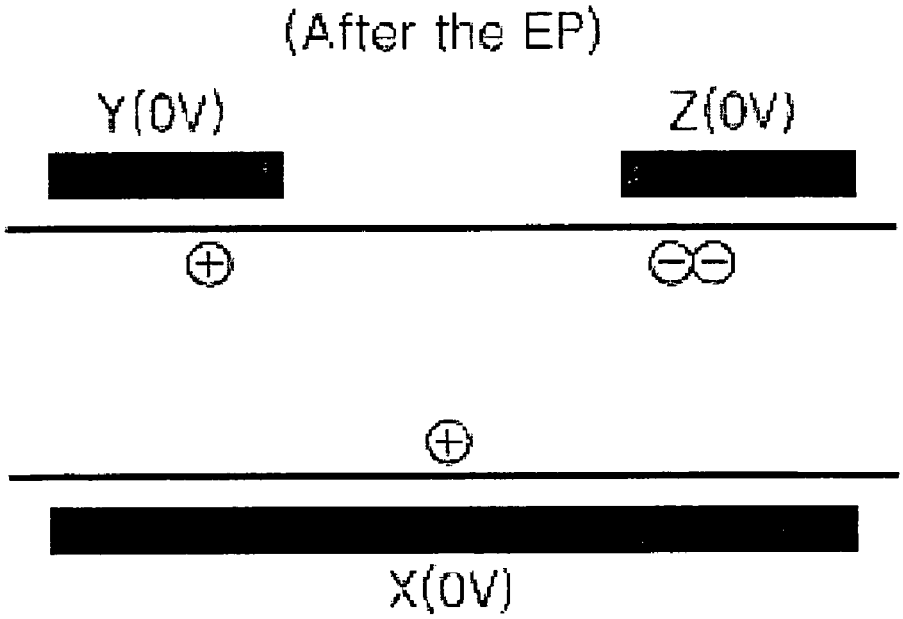
FIG. 4A (Prior Art)
FIGS. 4A to 4E illustrate a distribution of wall charges within a discharge cell by the driving waveform of FIG. 3.
Figure 4B:
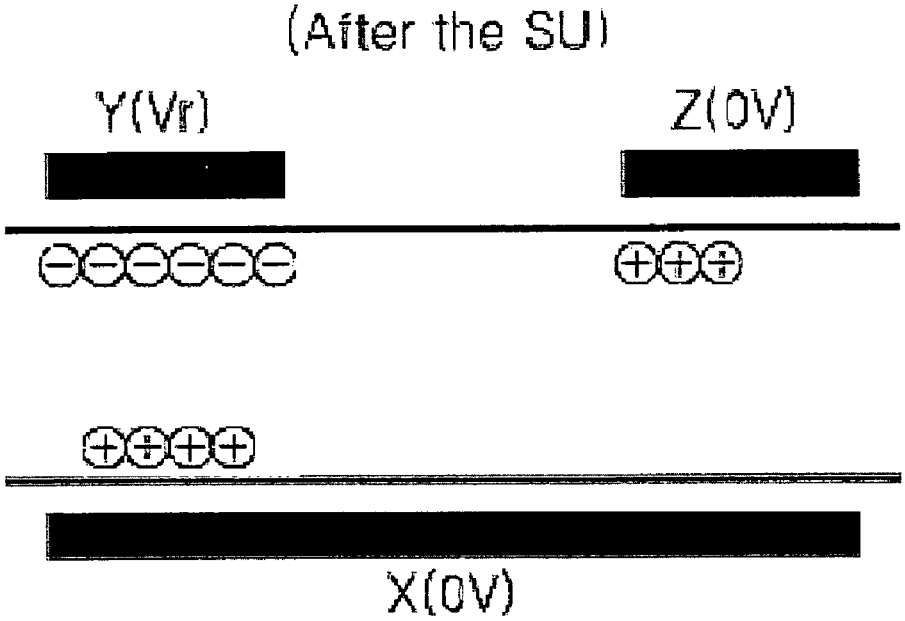
FIG. 4B (Prior Art)
Figure 4C:
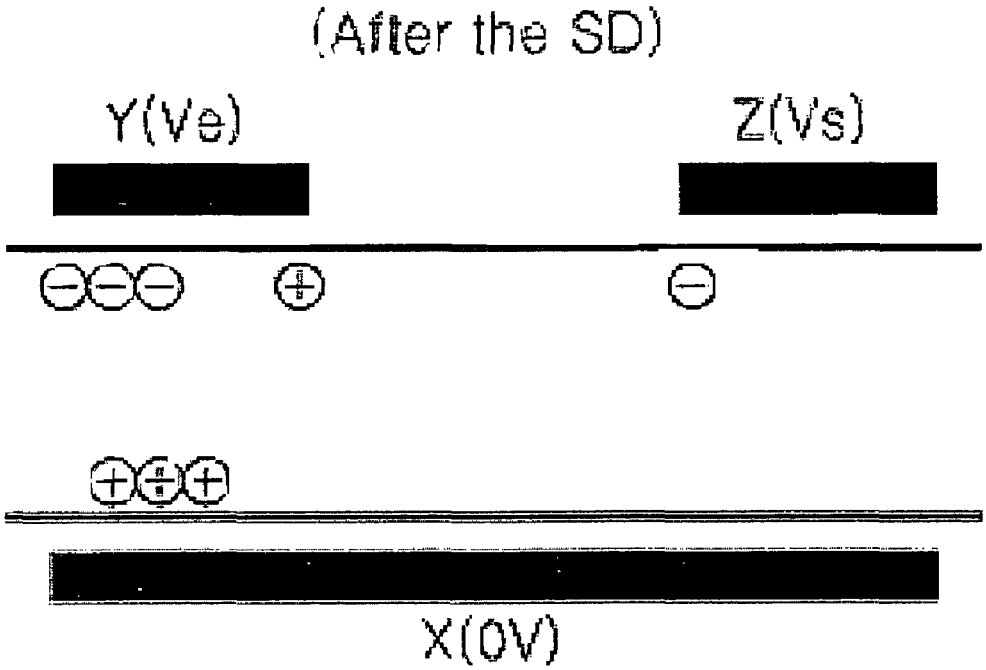
FIG. 4C (Prior Art)
Figure 4D:
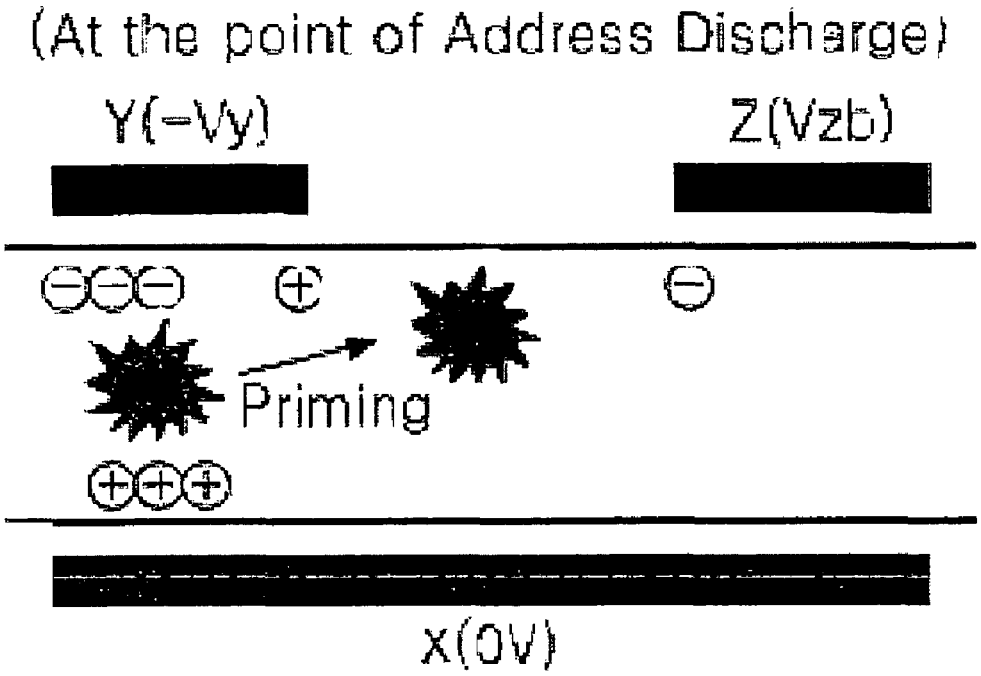
FIG. 4D (Prior Art)
Figure 4E:
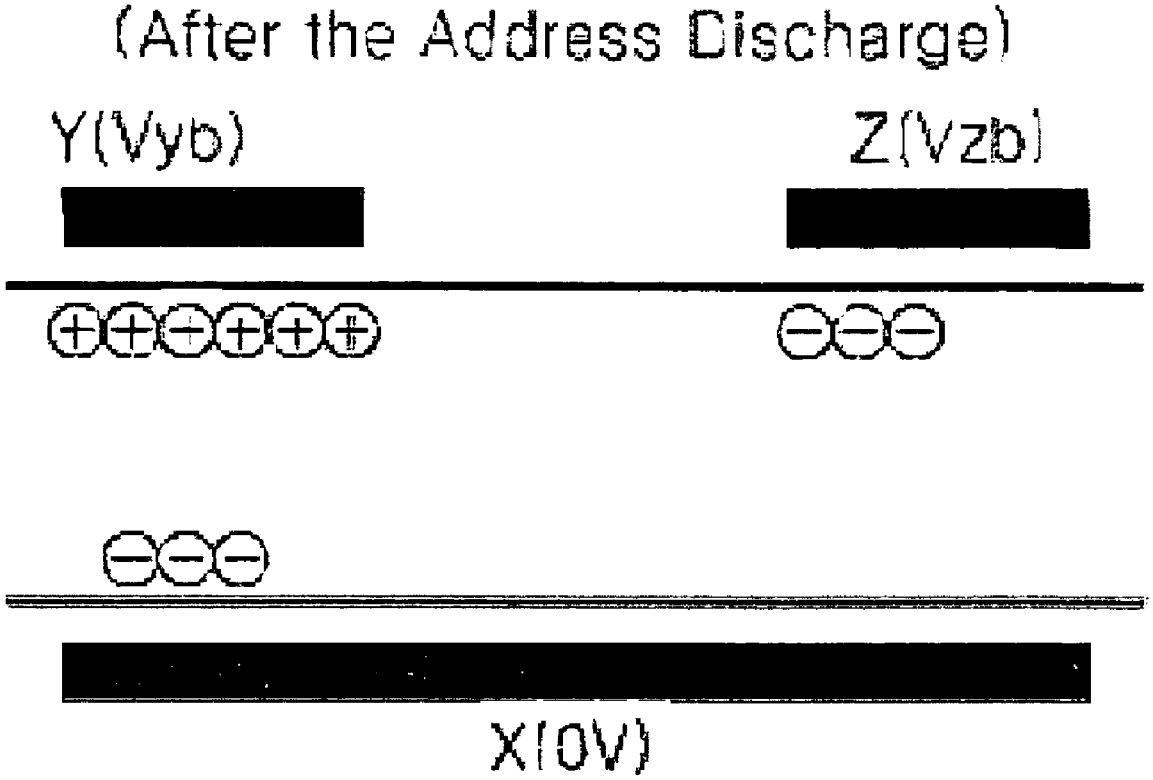
FIG. 4E (Prior Art)
Figure 5:
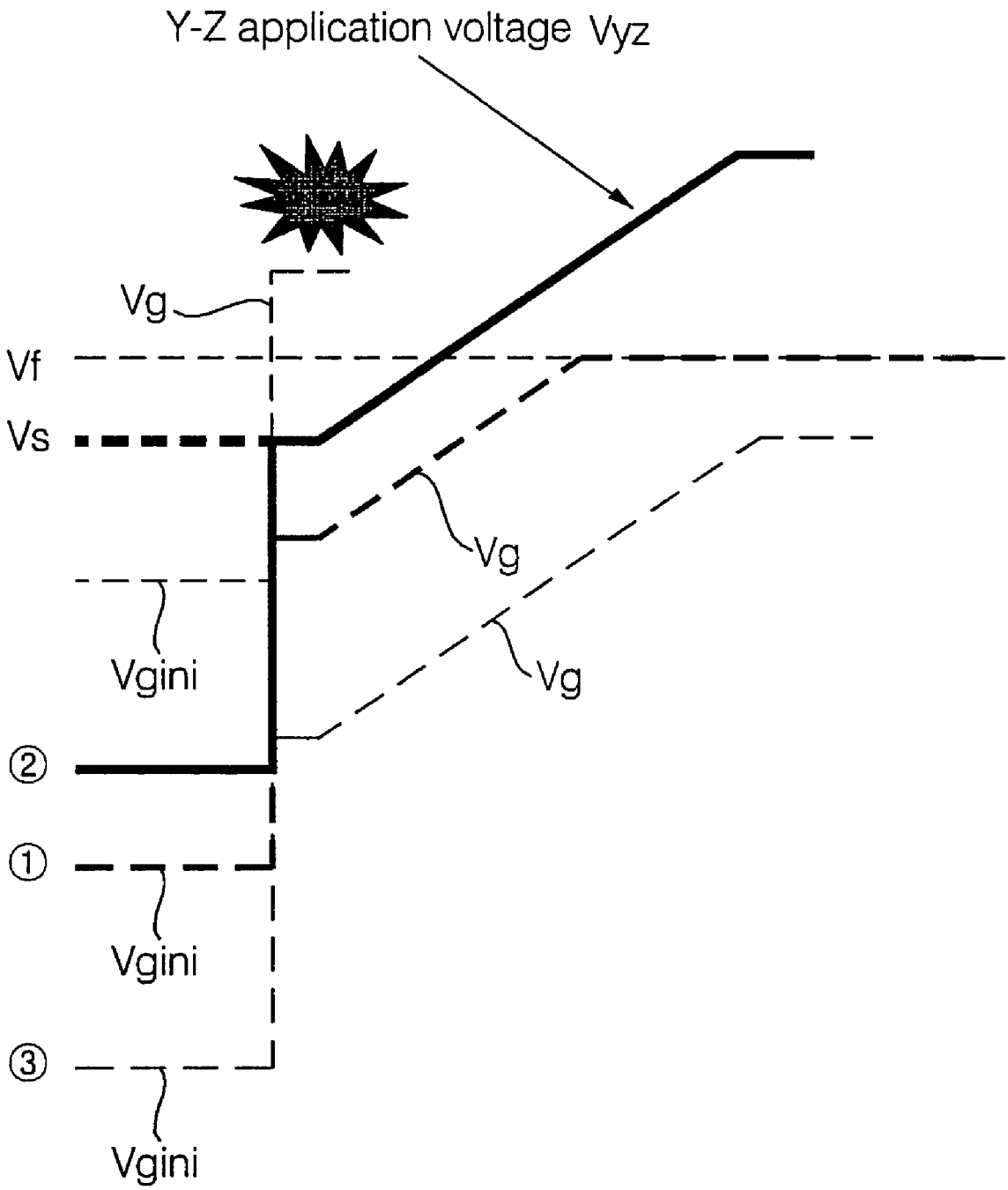
FIG. 5 (Prior Art)
FIG. 5 illustrates a variation of a gap voltage within a discharge cell in a conventional plasma display apparatus.
Figure 13:
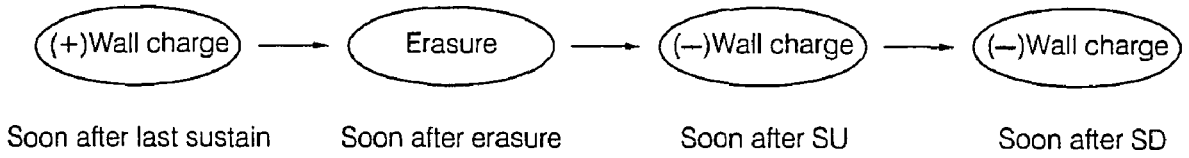
FIG. 13 illustrates a polarity variation of a wall charge on a sustain electrode during an erasure period and a reset period by a conventional driving waveform.
Figure 14:
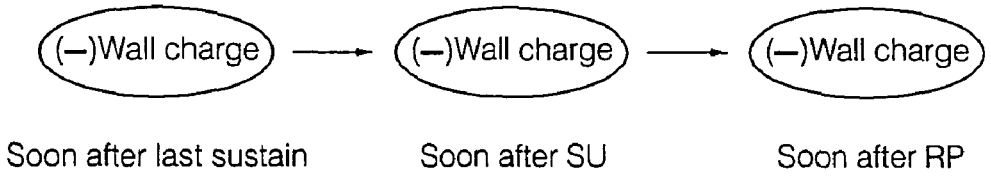
FIG. 14 illustrates a polarity variation of a wall charge on a sustain electrode during a reset period by a conventional driving waveform.

That the number of times of discharge generated in the reset period (RP) is less means that the wall charges or the polarities are less changed within the discharge cell. For example, in the conventional plasma display apparatus, as shown in FIG. 13, the wall charges on the sustain electrode (Z) are changed in polarity in a sequence of positive polarity, erasure (FIG. 4A), positive polarity (FIG. 4B), and negative polarity (FIG. 4C), from soon after a last sustain discharge of an (n−1)th subfield to soon after a dark discharge of a setdown period (SD) of an nth subfield. In comparison with this, in the inventive plasma display apparatus, as shown in FIG. 14, the wall charges on the sustain electrode (Z) are sustained to be in a negative polarity, from soon after the last sustain discharge of the (n−1)th subfield to soon after the dark discharge of the setdown period (SD) of the nth subfield. In other words, in the inventive plasma display apparatus, as shown in FIGS. 8A, 8B, and 8C, in an initialization process, the wall charges on the sustain electrode (X) are constantly sustained while the address period (AP) lapses.

Figure 15:
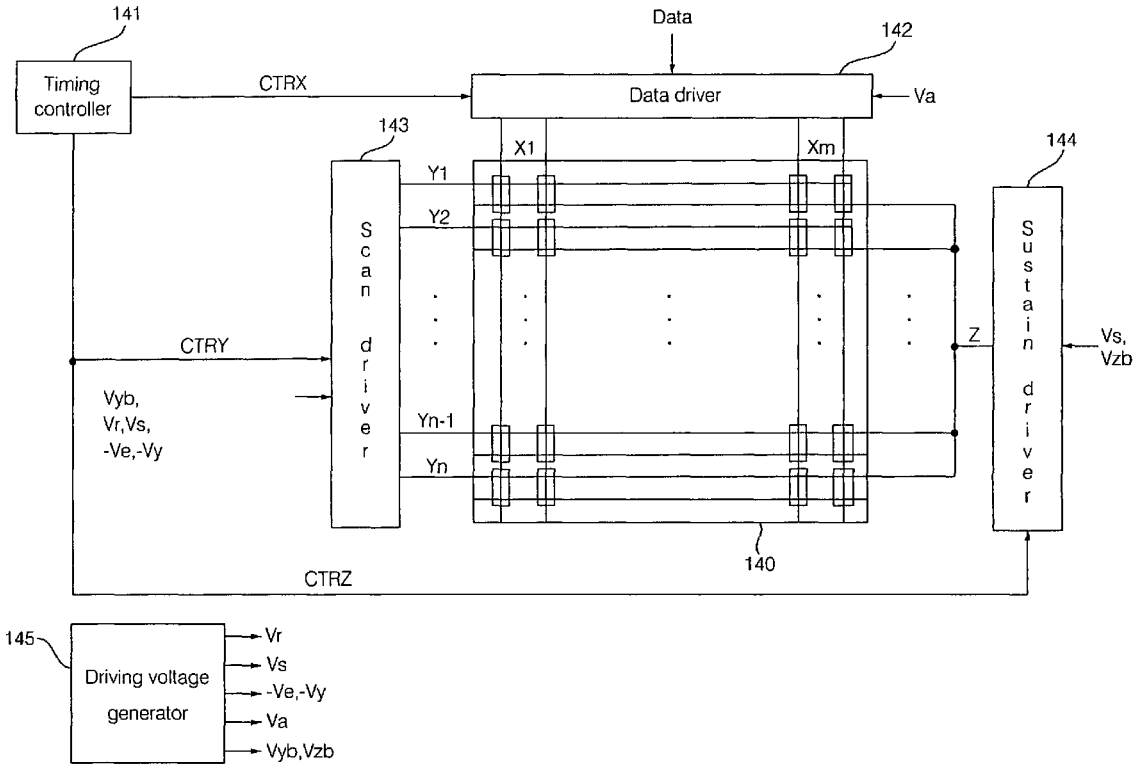
FIG. 15 is a block diagram illustrating a construction of a plasma display apparatus according to an embodiment of the present invention.

FIG. 15 is a block diagram illustrating the plasma display apparatus according to an embodiment of the present invention.

Referring to FIG. 15, the inventive plasma display apparatus includes a plasma display panel (PDP) 140; a data driver 142 being a third electrode driver for supplying data to the address electrodes (X1 to Xm) of the PDP 140; a scan driver 143 for driving the scan electrodes (Y1 to Yn) of the PDP 140; a sustain driver 144 for driving the sustain electrode (Z) of the PDP 140; a timing controller 141 for controlling the respective drivers 142, 143, and 144; and a driving voltage generator 145 for generating driving voltages necessary for the drivers 142, 143, and 144.

The data driver 142 receives data that is inverse-gamma corrected and error-diffused by an inverse gamma correction circuit and an error diffusion circuit, and is mapped to a preset subfield pattern by a subfield mapping circuit. The data driver 142 applies 0V or the base voltage to the address electrodes (X1 to Xm) in the pre reset period (PRERP), the reset period (RP), and the sustain period (SP). The data driver 142 samples and latches data under the control of the controller 141, and then supplies the data to the address electrodes (X1 to Xm) during the address period (AP).

As shown in FIG. 6, under the control of the timing controller 141, the scan driver 143 supplies the ramp waveforms (NRY, PRY1, and PRY2) in order to initialize the whole discharge cells in the pre reset period (PRERP) and the reset period (RP), and then sequentially supplies the scan pulse (SCNP) to the scan electrodes (Y1 to Yn) in order to select the scan line to which the data is supplied during the address period (AP). Further, the scan driver 143 supplies the sustain pulses (FSTSUSP and SUSP) to the scan electrodes (Y1 to Yn) in order to generate the sustain discharge within the on-cells selected in the sustain period (SP).

As shown in FIG. 6, under the control of the timing controller 141, the sustain driver 144 supplies the sustain voltage (Vs) to the sustain electrode (Z) in the pre reset period (PRERP), and supplies the Z bias voltage (Vzb) to the sustain electrode (Z) in the address period (AP). Further, the sustain driver 144 is operated alternately with the scan driver 143 in the sustain period (SP), and supplies the sustain pulses (FSTSUSP, SUSP, and LSTSUSP) to the sustain electrode (Z).

The timing controller 141 receives a vertical/horizontal synchronization signal and a clock signal, generates timing control signals (CTRX, CTRY, and CTRZ) necessary for the respective drivers 142, 143, and 144, and supplies the timing control signals (CTRX, CTRY, and CTRZ) to the corresponding drivers 142, 143, and 144, thereby controlling each of the drivers 142, 143, and 144. The timing control signal (CTRX) supplied to the data driver 142 includes a sampling clock for sampling data, a latch control signal, and a switch control signal for controlling on/off times of an energy recovery circuit and a driving switching element. The timing control signal (CTRY) applied to the scan driver 143 includes a switch control signal for controlling the on/off times of the energy recovery circuit and the driving switching element of the scan driver 143. The timing control signal (CTRZ) applied to the sustain driver 144 includes a switch control signal for controlling the on/off times of an energy recovery circuit and a driving switching element of the sustain driver 144.

The driving voltage generator 145 generates the driving voltages (Vry, Vs, −V1, −Vy, Va, Vyb, and Vzb) shown in FIG. 6 supplied to the PDP 140. These driving voltages can be varied depending on a discharge characteristic or a composition of discharge gas varied depending on a resolution and a model of the PDP 140.

Figure 16:
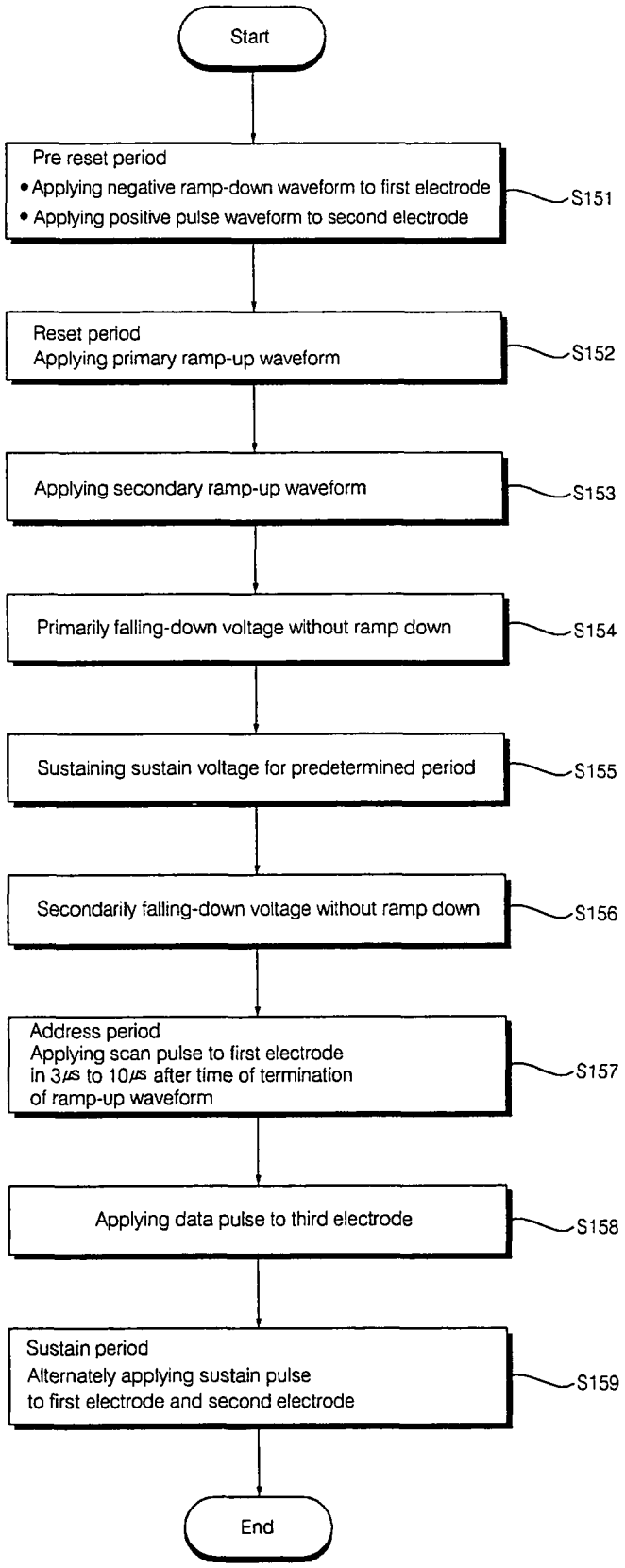
FIG. 16 is a flowchart illustrating a driving method of a plasma display apparatus according to the present invention.

FIG. 16 is a flowchart illustrating a driving method of the plasma display apparatus according to the present invention. Referring to FIG. 16, the inventive driving method of the plasma display apparatus will be described on a period basis of the respective divided pre reset, reset, address, and sustain periods of one subfield.

First, during the pre reset period, the negative voltage is applied to the first electrode (scan electrode) and the positive voltage is applied to the second electrode (sustain electrode) (Step 151). The negative voltage applied to the first electrode forms a waveform ramping-down from the ground voltage to the negative voltage. If such the voltage is applied to the first electrode and the second electrode, the dark discharge is generated. Through the above process, the enough great positive gap voltage is formed between the scan electrode (Y) and the sustain electrode (Z) in the internal discharge gas spaces of the whole discharge cells by the distribution of wall charges of FIG. 8A, and the electric field directing from the scan electrode (Y) to the sustain electrode (Z) is formed within each discharge cell.

Next, in the reset period, a voltage gradually rises up to the reset voltage and is applied to the first electrode. Preferably, the voltage rises up to the reset voltage with a two-step slope.

First, if the reset period is initiated, a voltage rises from the ground voltage to the sustain voltage with a first slope (Step 152), and a voltage rises from the sustain voltage to the reset voltage with a second slope (Step 153).

The second slope is gentler than the first slope. In other words, a first half of the reset period is abrupt in slope, and a second half is gentle in slope. By using a waveform having the gentle slope in the second half of the reset period, the wall charges can be minutely controlled.

Next, substantially without the ramp down, the voltage reduces from the reset voltage to the base voltage and is applied (Step 154). In other words, by removing the setdown period from the reset period, a margin of the driving signal can be secured. However, if the voltage is abruptly reduced from the reset voltage to the base voltage and, when the address period is initiated, the base voltage is applied, the erroneous discharge can occur.

Accordingly, for more stable driving, the voltage falls from the reset voltage to the sustain voltage substantially without the ramp down (Step 154) and is sustained for a predetermined short period (Step 155), and the voltage completely falls from the sustain voltage to the base voltage (Step 156).

The base voltage is the ground voltage or a voltage lower than the ground voltage, and serves as the scan reference voltage during the address period.

As described above, the address period is directly followed without the ramp down. The distribution of wall charges when the reset period terminates is shown in FIG. 8B.

Next, in the address period, the scan pulse is sequentially applied to the plurality of scan electrodes. As described above, the voltage directly falls up to the base voltage without the ramp down and therefore, the reset period gets short and accordingly an application time point of a first scan pulse is shortened as shown in FIG. 9.

The application time point of the first scan pulse is in about 3 μs to 10 μs from a time point of termination of the reset period, that is, termination of the ramp-up waveform (Step 157). For example, the first scan pulse is applied before and after about 5 μs so that remaining 145 μs or more can be allocated to the address period in comparison with the related art where a first scan pulse is applied in at least 150 μs.

By allocating much as the shortened reset period to the address period as described above, a long address period needing in a single scan driving method can be satisfied.

The positive data pulse is synchronized to the scan pulse and is applied to the address electrode being the third electrode (Step 158). In one of several discharge cells where the scan pulse and the data pulse are simultaneously applied, an opposite discharge occurs. In the on-cells, the gap voltage between the scan electrode and the address electrode exceeds the firing voltage, thereby generating the address discharge only between the corresponding electrodes.

The distribution of wall charges just before the address discharge is shown as in FIG. 8C. Soon after the address discharge, as in FIG. 8D, in the distribution of wall charges within the on-cells, by the address discharge, the positive wall charges are accumulated on the scan electrodes, and the negative wall charges are accumulated on the address electrodes.

In the off-cells, any one of the scan voltage and the data voltage in the corresponding cell is the ground voltage. Therefore, the gap voltage between the scan electrode and the address electrode is lower than the firing voltage, thereby not generating the discharge so that the distribution of wall charges of FIG. 8B is substantially sustained.

Next, in the sustain period, the sustain pulses are alternately applied to the scan electrode and the sustain electrode (Step 159). The sustain pulse first applied to each electrode is greater in pulse width than the normal sustain pulse subsequently applied. This is to generate a first sustain discharge more stably and surely.

Further, the last sustain pulse applied to the sustain electrode is set to be greater in pulse width than the normal sustain pulse in order to sufficiently accumulate the negative wall charges on the sustain electrode in an initial state of the reset period of the subsequent next subfield.

During this period, in the on-cell, owing to the distribution of wall charges of FIG. 8D, whenever every sustain pulse is applied, the sustain discharge is generated between the scan electrodes and the sustain electrodes, thereby expressing the gray level corresponding to the number of corresponding sustain pulses.

On the contrary, in the off-cell, the distribution of wall charges at an initial time of the sustain period is as in FIG. 8B and therefore, even though the sustain pulse is applied, the gap voltage is sustained to be less than the firing voltage, thereby not generating the discharge.

The inventive driving method can be used in but is not limited to the first subfield of the frame and is applicable to several initial subfields including the first subfield and is applicable to all subfiels constituting one frame.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus comprising:

an electrode pair having a first electrode and a second electrode, and a third electrode intersecting with the electrode pair; and a first electrode driver, a second electrode driver, and a third electrode driver for applying driving signals to the respective electrodes, wherein:

the first electrode driver applies a waveform ramping-up to a reset voltage during a reset period and falling down to a base voltage without a ramp down, scan pulses are applied during an address period, a first scan pulse is applied 3 μs to 10 μs after a time point of termination of the ramping-up waveform, the second electrode driver substantially applies a first reference voltage throughout substantially all of the reset period, the waveform falls down from the reset voltage to substantially a sustain voltage and then falls down from substantially the sustain voltage to the base voltage after the sustain voltage is sustained for a predetermined time, and the waveform falls down from the reset voltage to substantially the sustain voltage at a first rate and falls down from substantially the sustain voltage to the base voltage at a second rate, with the first and second rates corresponding to substantially a same rate.

2. The apparatus of claim 1, wherein the base voltage is a ground voltage or a predetermined voltage of less than the ground voltage.

3. The apparatus of claim 1, wherein the ramp-up waveform includes a first waveform that ramps-up up to a sustain voltage with a first slope that is at least substantially linear, and a second waveform that ramps-up from the sustain voltage to the reset voltage with a second slope that is at least substantially linear.

4. The apparatus of claim 3, wherein the second slope is gentler than the first slope.

5. The apparatus of claim 1, wherein the first electrode driver applies a negative voltage during a pre reset period before the reset period, and the second electrode driver applies a positive voltage while the first electrode driver applies the negative voltage.

6. The apparatus of claim 5, wherein the first electrode driver applies a waveform ramping-down from the base voltage to the negative voltage, and the second electrode driver applies a waveform of a pulse form having the positive voltage as a maximal electric potential.

7. The apparatus of claim 5, wherein the positive voltage has the same magnitude as a sustain voltage.

8. The apparatus of claim 1, wherein the second electrode driver applies a waveform during an address period that steps up from the first reference voltage to a second reference voltage, and then from the second reference voltage to a third reference voltage.

9. The apparatus of claim 1, wherein the second electrode driver applies a waveform during an address period that ramps up from the first reference voltage until a predetermined time point and then vertically rises up to a second reference voltage.

10. The apparatus of claim 1, wherein, when a first sustain pulse is applied, the first electrode driver applies a waveform stepping up from the base voltage to a ground voltage and rising up to a sustain voltage.

11. The apparatus of claim 10, wherein, in a sustain period, the first sustain pulse has a greater width than remaining sustain pulses.

12. The apparatus of claim 1, wherein the second electrode driver applies a pulse where a last sustain pulse has a greater width than a just previous sustain pulse.

13. The apparatus of claim 1, wherein the first electrode driver applies the first scan pulse in about 5 μs after the time point of the termination of the ramping-up waveform.

14. The apparatus of claim 1, wherein the first and second rates correspond to at least a substantially vertical slope.

15. The apparatus of claim 1, wherein the second electrode receives a plurality of sustain pulses during a sustain period, said sustain pulses including:

a first pulse having a first width, at least one second pulse having a second width, and a third pulse having a third width different from the first and second widths.

16. The apparatus of claim 15, wherein the third pulse is a last sustain pulse and the first pulse is a first sustain pulse and wherein the third width is greater than the second width and less than the first width.

17. The apparatus of claim 1, wherein the reset period ends at substantially a same time as when the waveform applied to the first electrode falls down to the base voltage.

18. The apparatus of claim 1, wherein the base voltage is lower than a reference voltage of sustain pulses applied to the first and second electrodes.

19. The apparatus of claim 18, wherein the reference voltage of the sustain pulses is substantially a ground voltage and the base voltage is lower than the ground voltage.

* * * * *